US006385427B1

(12) United States Patent
Nakane

(10) Patent No.: US 6,385,427 B1
(45) Date of Patent: May 7, 2002

(54) TANDEM-TYPE IMAGE FORMING APPARATUS HAVING FULL-COLOR PRINT MODE AND SINGLE-COLOR PRINT MODE

(75) Inventor: Eiji Nakane, Okazaki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/612,321

(22) Filed: Jul. 7, 2000

Related U.S. Application Data

(62) Division of application No. 09/099,798, filed on Jun. 18, 1998, now Pat. No. 6,108,510.

(30) Foreign Application Priority Data

| | | |
|---|---|---|
| Jun. 20, 1997 | (JP) | 9-163879 |
| Jan. 13, 1998 | (JP) | 10-004511 |
| May 8, 1998 | (JP) | 10-125934 |

(51) Int. Cl.[7] ..... G03G 15/01
(52) U.S. Cl. ..... 399/303; 399/298
(58) Field of Search ..... 399/312, 314, 399/318, 299, 300, 303, 306, 82, 138, 58, 298, 310, 311

(56) References Cited

U.S. PATENT DOCUMENTS

| | | | | |
|---|---|---|---|---|
| 4,531,828 A | | 7/1985 | Hoshino | |
| 4,723,146 A | | 2/1988 | Kasahara | |
| 4,933,727 A | * | 6/1990 | Mizuma et al. | 399/298 |
| 5,010,372 A | * | 4/1991 | Kasahara et al. | 399/78 |
| 5,153,651 A | | 10/1992 | Kurotaka | |
| 5,187,536 A | * | 2/1993 | Hasegawa et al. | 399/300 |
| 5,303,018 A | | 4/1994 | Terada et al. | |
| 5,313,259 A | | 5/1994 | Smith | |
| 5,335,052 A | | 8/1994 | Sato et al. | |
| 5,602,629 A | * | 2/1997 | Saito et al. | 399/58 |
| 5,678,150 A | * | 10/1997 | Takahashi et al. | 399/299 |
| 5,765,082 A | * | 6/1998 | Numazu et al. | 399/299 |
| 5,765,094 A | * | 6/1998 | Nakamura | 399/298 X |
| 5,893,017 A | | 4/1999 | Yamamoto | |
| 5,930,556 A | | 7/1999 | Imamiya | |
| 5,943,526 A | | 8/1999 | Kodama | |
| 6,009,298 A | * | 12/1999 | Sakamaki et al. | 399/318 |
| 6,108,510 A | * | 8/2000 | Nakane | 399/303 |

FOREIGN PATENT DOCUMENTS

| | | | |
|---|---|---|---|
| JP | 60-142370 | * | 7/1985 |
| JP | 1-177568 | | 7/1989 |
| JP | 3-142459 | * | 6/1991 |
| JP | 4-81876 | | 3/1992 |
| JP | 4-221982 | | 8/1992 |
| JP | 5-107853 | * | 4/1993 |
| JP | 5-336331 | * | 12/1993 |
| JP | 6-27837 | * | 2/1994 |
| JP | 6-18364 | * | 5/1994 |
| JP | 6-43813 | * | 11/1994 |
| JP | 8-63052 | * | 3/1996 |

* cited by examiner

*Primary Examiner*—Susan S. Y. Lee
(74) *Attorney, Agent, or Firm*—Morrison & Foerster LLP

(57) ABSTRACT

The system speed of the image forming apparatus is controlled to operate in one of two modes. In one embodiment, a controller coordinates the operation of a plurality of image forming units and the transporter. The controller sets a system speed of the image forming apparatus at a first speed when a first mode is set to form a color image using the plurality of image forming units and sets the system speed of the image forming apparatus at a second speed which is faster than the first speed when a second mode is set to form a single-color image using only an image forming unit provided at a most downstream position in a transportation direction of the transporter. In another embodiment, a controller coordinates the operation of the plurality of image forming units and the transporter, and sets a system speed at a first speed when a first mode is set to form a color image using the plurality of image forming units and sets the system speed at a second speed which is slower than the first speed when a second mode is set to form a single-color image using only one of the plurality of image forming units and a special sheet different from plain paper is used as the recording sheet.

9 Claims, 16 Drawing Sheets

TANDEM-TYPE IMAGE FORMING APPARATUS HAVING FULL-COLOR PRINT MODE AND SINGLE-COLOR PRINT MODE

This application is a division of U.S. application Ser. No. 09/099,798, filed Jun. 18, 1998, U.S. Pat. No. 6,108,510.

This application is based on applications No. 9-163879, No. 10-004511, and No. 10-125934, filed in Japan, the contents of which are hereby incorporated by reference.

BACKGROUND OF THE INVENTION (1) Field of the Invention

The present invention relates to a so called "tandem-type" image forming apparatus which is provided with a plurality of image forming units and which is capable of operating in a full-color print mode and a single-color print mode. All of the image forming units are operative in the full-color print mode to form a color image, while only one of the image forming units is operative in the single-color mode to form a single-color image.

(2) Related Art

A tandem-type image forming apparatus, as one example of a conventional full-color image forming apparatus, has image forming units corresponding to toner colors set in line. A transport means of a tandem-type image forming apparatus transports a recording sheet to each transfer position (i.e., a position at which a toner image is transferred onto the recording sheet) of the image forming units. Color toner images formed by the image forming units are sequentially superimposed to form a full-color image on the recording sheet.

In general, a tandem-type image forming apparatus has four image forming units corresponding to four colors, that is, cyan (C), magenta (M), yellow (Y), and black (K). The image forming unit used for forming a black image is usually set at a rearmost position of a transportation path of the recording sheet transported by the transport means to prevent blurring of colors. An attraction charger is set at a frontmost position of the transportation path of the recording sheet and charges the recording sheet supplied from a sheet supply unit so that it is attracted to the transport means. The recording sheet is attracted to the transport means by the electrostatic charge of the attraction charger and sequentially transported to each transfer position of the image forming units without moving away from a correct position on the transport means. As a result, the multicolor image can be formed without color displacement.

A transport belt can be used as the transport means. In general, a transport belt is made of a semi-conductive material to encourage the self-elimination of static. The surface potential of the transport belt gradually decreases with time after the transport belt has been charged. For this reason, the electrostatic force which attracts the recording sheet decreases as the recording sheet is transported in a transport direction thereof. However, when a full-color image is formed, the recording sheet and the transport belt are charged with transfer voltage at the transfer positions of the image forming units for cyan, magenta, yellow, and black in addition to being charged by the attraction charger. Consequently, the recording sheet can be reliably transported all of the way to a fixing device, with the attraction being maintained above a predetermined level.

When only one of the image forming units is used, however, such as when forming a black image using only the final image forming unit, the recording sheet may move away from the correct position on the transport means before reaching the transfer position of the image forming unit used for forming the black image since the electrostatic force applied to the transport means decreases due to the self-elimination of static. Alternatively, a paper jam may occur, depending on the type of the recording sheet being used and the conditions inside the image forming apparatus.

Japanese Laid-Open Patent Application No. 4-221982 teaches an example of a tandem-type image forming apparatus which has all of the image forming units apply a transfer voltage even when the image is formed using only some of the image forming units. Thus, the electrostatic force of the recording sheet attracted to the transport means can be sufficiently maintained even when the image is formed using not all of the image forming units, so that the recording sheet does not move away from the correct position on the transport means.

General speaking, however, in organizations such as offices, the number of image formations using only some of the image forming units, such as operations using only the image forming unit for forming a black image, will be considerably higher than the number of image formations using all of the image forming units for forming color images. As in the cited Japanese application, if electrostatic charge is applied the same number of times, regardless of whether the single-color image formation or the full-color image formation, there will be an increase in power consumption in addition to a great acceleration in the wear and tear on the transport means.

Tandem-type image forming apparatuses are usually provided with a variety of modes in addition to the ability to select between the color image formation and the single-color image formation. If electrostatic charge is applied to the recording sheet to be attracted to the transport means the same number of times, regardless of the current mode, there will be an increase in power consumption in addition to a great acceleration in the wear and tear on the transport means.

The tandem-type image forming apparatus operates based on the premise that high-quality paper is used as the recording sheet for better reproduction of color images. By using high-quality paper, the attraction of the recording sheet relative to the transport means is ensured. FIG. 1 is a graph which compares the attraction of high-quality paper, with those of recycled paper and low-grade paper which have rough surfaces.

As shown in the graph, the attraction of recycled paper and low-grade paper are extremely low, compared with the attraction of high-quality paper. As such, when recycled paper or the like is used as the recording sheet in the conventional tandem-type image forming apparatus, the recording sheet is not reliably transported, and so is skewed or moves away from the correct position on the transport means. At worst, the transport means cannot transport the recording sheet, causing a paper jam.

However, there are increasing user demands for the use of recycled paper or other low-grade paper as the recording sheet to reduce costs, since it is not necessary to consider the prerequisites for color reproduction when reproducing a single-color image.

SUMMARY OF THE INVENTION

The primary object of the present invention is to provide an image forming apparatus by which the stated problems are solved.

The first object of the present invention is to provide an image forming apparatus which can considerably prevent the short lifespan of the transport unit.

The second object of the present invention is to provide an image forming apparatus which can maintain the transport of the recording sheet stable in each image forming mode by controlling the electrostatic attraction of the recording sheet relative to the transport unit as necessary, and considerably prevent the short lifespan of the transport unit.

The third object of the present invention is to provide an image forming apparatus which can avoid the problem, such as a skew and a movement of the recording sheet on the transport unit, when a sheet whose surface is rough is used as the recording sheet in the single-color image formation.

The above-mentioned objects can be achieved by an image forming apparatus made up of: a plurality of image forming units, each including an image holding component on which an image for a different color is formed and including a transfer component for transferring the image formed on each image holding component onto a recording sheet at a respective transfer position; a transporter for holding a recording sheet and sequentially transporting the recording sheet to each transfer position of the plurality of image forming units; and a controller which sets a system speed of the image forming apparatus at a first speed when a first mode is set to form a color image using the plurality of image forming units and sets the system speed of the image forming apparatus at a second speed which is faster than the first speed when a second mode is set to form a single-color image using only one of the plurality of image forming units, with the system speed being equivalent to a transportation speed of the recording sheet by the transporter.

The above-mentioned objects can be achieved an image forming apparatus made up of: a plurality of image forming units, each including an image holding component on which an image for a different color is formed and including a transfer component for transferring the image formed on each image holding component onto a recording sheet at a respective transfer position; a transporter for holding a recording sheet and sequentially transporting the recording sheet to each transfer position of the plurality of image forming units; a first attraction unit which applies attractive force that attaches the recording sheet to a recording sheet supporting surface of the transporter, the first attraction unit being located at upstream side of an image forming unit which is located at a most upstream side in a transporting direction of the recording sheet by the transporter; a second attraction unit which increases the attractive force of the recording sheet which was applied by the first attraction unit, the second attraction unit being located at downstream side of the first attraction unit in the transporting direction of the recording sheet; and a controller which makes only the first attraction unit operative when a first mode is set to form a color image using the plurality of image forming units and makes both of the first attraction unit and the second attraction unit operative when a second mode is set to form a single-color image using only one of the plurality of image forming units.

The above-mentioned objects can also achieved by an image forming apparatus made up of: a plurality of image forming units, each including an image holding component on which an image for a different color is formed and including a transfer component for transferring the image formed on each image holding component onto a recording sheet at a respective transfer position; a transporter for holding a recording sheet and sequentially transporting the recording sheet to each transfer position of the plurality of image forming units; and a controller which sets a system speed of the image forming apparatus at a first speed when a first mode is set to form a color image using the plurality of image forming units, and sets the system speed of the image forming apparatus at a second speed which is slower than the first speed when a second mode is set to form a single-color image using only one of the plurality of image forming units and special paper aside from plain paper is used as the recording sheet, with the system speed being equivalent to a transportation speed of the recording sheet by the transporter.

The above-mentioned objects can be achieved by an image forming apparatus made up of: a plurality of image forming units, each including an image holding component on which an image for a different color is formed and including a transfer component for transferring the image formed on each image holding component onto a recording sheet at a respective transfer position; a transporter for holding a recording sheet and sequentially transporting the recording sheet to each transfer position of the plurality of image forming units; and a controller which sets a transfer pressure at a first pressure for each of the plurality of image forming units when a first mode is set to form a color image using the plurality of image forming units, and sets the transfer pressure at a second pressure which is higher than the first pressure for the image forming units which are not used for forming a single-color image when a second mode is set to form the single-color image using only one of the plurality of image forming units.

The above-mentioned objects can be also achieved by an image forming apparatus made up of: a plurality of image forming units, each including an image holding component on which an image for a different color is formed and including a transfer component for transferring the image formed on each image holding component onto a recording sheet at a respective transfer position; a transporter for holding a recording sheet and sequentially transporting the recording sheet to each transfer position of the plurality of image forming units; and a controller which controls each transfer component to change an electric field so that an area that is acted upon by the electric field is a first area when a first mode is set to form a color image using the plurality of image forming units, and to change the electric field so that the area that is acted upon by the electric field is a second area which is larger than the first area when a second mode is set to form the single-color image using only one of the plurality of image forming units.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF PREFERRED EMBODIMENT

The following is a description of several embodiments of the image forming apparatus of the present invention. In these embodiments, a tandem-type full-color image forming apparatus is used as an example of such an image forming apparatus (simply referred to as the "copier" hereinafter).

First Embodiment (1) Construction of Image Forming Unit of Copier

Figure 1:
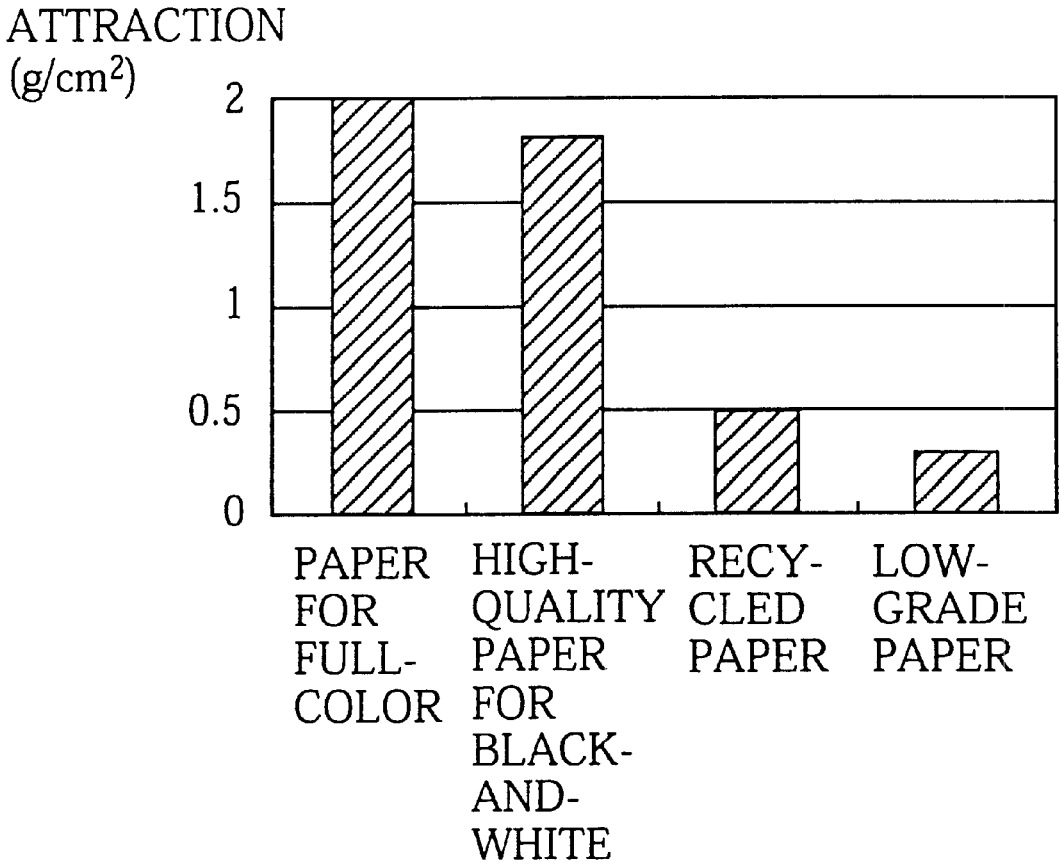
FIG. 1 is a graph showing the correspondence between the recording sheet type and its attraction relative to the transport belt.
Figure 2:
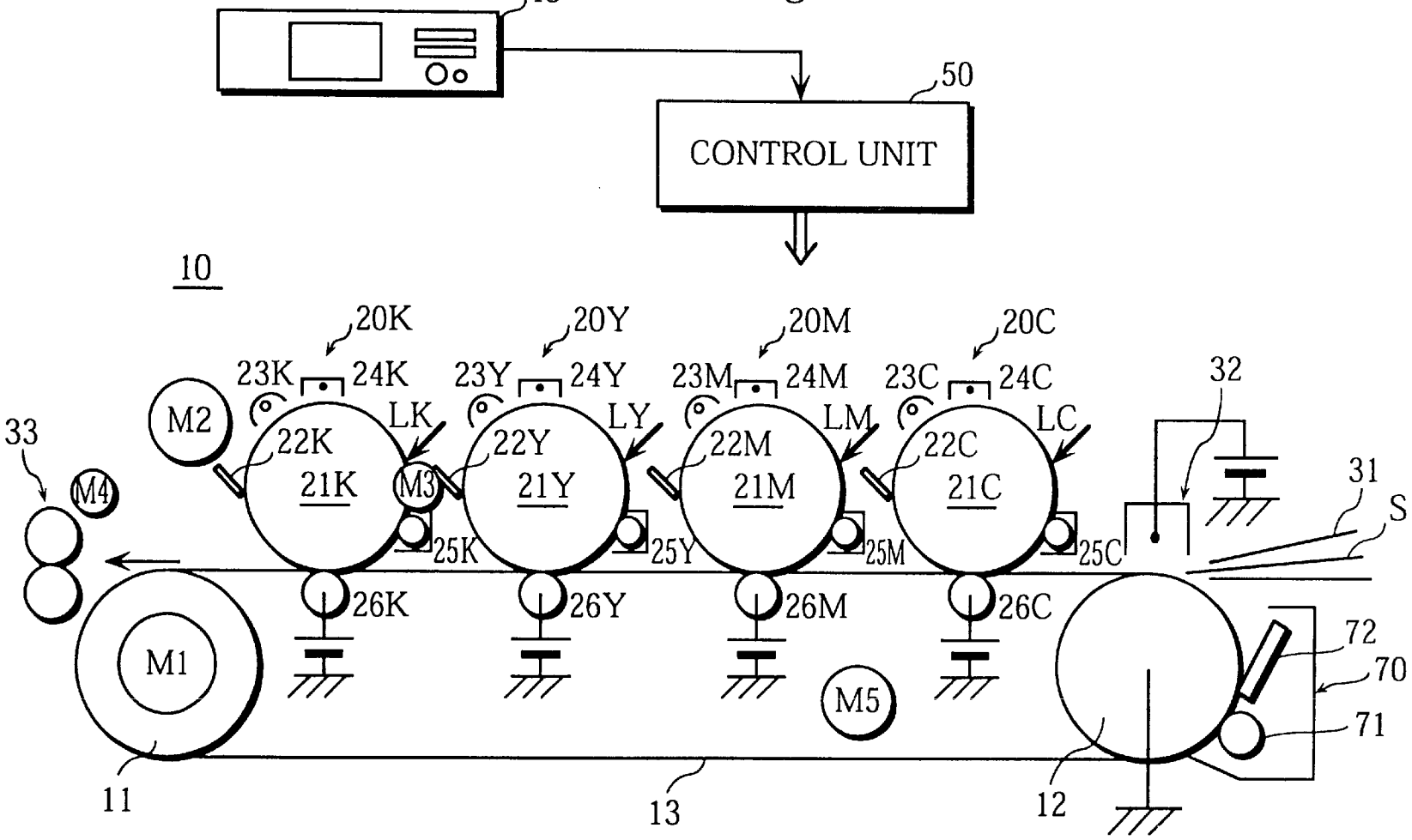
FIG. 2 shows the construction of an image forming section provided in a tandem-type full-color image forming apparatus of the first embodiment of the present invention.

FIG. 2 shows the construction of an image forming section 10 provided in a copier of the first embodiment of the present invention.

The reproduction colors cyan, magenta, yellow, and black are respectively referred to as C, M, Y, and K hereinafter and components related to these colors are assigned numerals with a corresponding C, M, Y, or K. As shown in FIG. 2, the image forming section 10 is composed of image forming units 20C to 20K for respectively forming an image in the corresponding color. The image forming units 20C, 20M, 20Y, and 20K are uniformly spaced from the right to the left (as the copier is viewed in FIG. 2) in this order along a transport belt 13 which runs over a drive roller 11 and a slave roller 12.

The image forming units 20C to 20K are respectively composed of photosensitive drums 21C to 21K as central components, cleaning blades 22C to 22K, eraser lamps 23C to 23K, sensitizing chargers 24C to 24K and developing units 25C to 25K. Transfer rollers 26C to 26K are also provided, and are each located under a different one of the photosensitive drums 21C to 21K, with the transport belt 13 in between. FIG. 2 shows a state where a positive voltage is applied to the transfer rollers 26C to 26K. In practice, however, the applying of the voltage is controlled by a control unit 50 in accordance with a print mode, as described later in this specification.

An image reading unit (not illustrated) reads image data of a document and separates the read data into color image data for red(R), green(G), and blue(B). Predetermined correction processing, such as shading correction, is performed on the R, G, and B image data, which is then converted into print data for reproduction colors C, M, Y, and K. In accordance with print data for each color, light-modulated laser beams LC to LK are respectively emitted from corresponding laser diodes and expose the corresponding surfaces of the photosensitive drums 21C to 21K.

When the photosensitive drums 21C to 21K are respectively exposed by the laser beams LC to LK, electrostatic latent images of different colors are formed on the surfaces of the photosensitive drums 21C to 21K. Toner images are then formed by the corresponding developing units 25C to 25K which supply respective color toners.

Each of the toner images is sequentially transferred onto a recording sheet S which is transported by the transport belt 13 at a transfer position (i.e., the position where each photosensitive drum and the corresponding transfer roller are facing each other), by means of electrostatic charge applied by the corresponding transfer rollers 26C to 26K. Here, each image forming operation is executed in synchronization with the timing at which the recording sheet S reaches each transfer position of the image forming units, so that each toner image is transferred onto the recording sheet S at the correct position.

The recording sheet S is guided from a sheet supply unit (not illustrated) to a guide plate 31 and carried to the transport belt 13. An attraction charger 32 is set at a sheet supply position, i.e., the frontmost part of the transport belt 13, for charging the recording sheet S and transport belt 13. The recording sheet S is electrostatically attracted to the transport belt 13 and sequentially transported to the transfer positions of the photosensitive drums 21C to 21K without moving away from the correct position on the transport belt 13.

Consequently, the toner images are sequentially transferred onto the recording sheet S, and are fused and fixed in place by a fixing device. Finally, the recording sheet S is discharged onto a discharge tray (not illustrated).

It should be noted here that M1 to M4 shown in FIG. 2 are stepping motors which respectively serve as a transport belt drive motor, a photosensitive drum drive motor, a developing unit drive motor, and a fixing device drive motor. Driving forces of the transport belt drive motor M1 and the fixing device drive motor M4 are transmitted to corresponding drive shafts directly or via appropriate deceleration mechanisms, such as gear devices. A driving force of the photosensitive drum drive motor M2 is transmitted to each rotational axis of the photosensitive drums 21C to 21K via a gear device, such as a worm gear, so that the photosensitive drums 21C to 21K are rotated at predetermined speed. An electromagnetic clutch is set on each driving force transmission path from the photosensitive drum drive motor M2 to the photosensitive drums 21C to 21Y. When a black image is formed, the control unit 50 controls the photosensitive drum 21K to rotate and the photosensitive drums 21C to 21Y not to rotate by turning the electromagnetic clutches off.

In the same way, a driving force of the developing unit drive motor M3 is transmitted to each drive shaft of the developing units 25C to 25K via a gear device and electromagnetic clutches. When a black image is formed using only the developing unit 25K, the control unit 50 has only the developing unit 25K operative by turning off the electromagnetic clutches which are set on the driving force transmission paths from the developing unit drive motor M3 to the developing units 25C to 25Y.

A cleaning unit 70, which is provided for the transport belt 13, scrapes off toner particles remaining on the surface of the transport belt 13 using a cleaning roller 71 and a cleaning blade 72 internally set in the cleaning unit 70. By means of the cleaning unit 70, the lower surface of the recording sheet S is not stained by remaining toner particles.

An operation panel 40 is provided on an optimum position on the top of the copier, and receives inputs from a user. In accordance with the inputted content, the control unit 50 controls the components of the copier to perform each operation so as to achieve a smooth image formation.

The above explanation refers to the mode where a color image is formed using all four image forming units (referred to as the "full-color print mode" hereinafter). When the copier operates in a mode where a black image is formed (referred to as the "single-color print mode" hereinafter), the control unit 50 makes only the image forming unit 20K operative and makes the image forming units 20C to 20Y inoperative by turning off the electromagnetic clutches to stop the rotation of the photosensitive drums 21C to 21Y and the developing units 25C to 25Y. This prevents unnecessary abrasion of these components. Also, the voltage application to the transfer rollers 26C to 26Y is stopped, thereby saving energy and reducing the number of times the transport belt 13 is charged in the single-color mode. In general, the charge characteristics of the semi-conductive material change as it is repeatedly charged. This is to say, the more times a semi-conductive material is charged, the weaker the electrostatic attraction becomes. For the present device, this means that there is a gradual decrease in the attraction of the recording sheet S to the transport belt 13, so that eventually stable transportation of the recording sheet S is no longer possible. However, by reducing the number of times the transport belt 13 is charged in the single-color image formation, wear and tear on the transport belt 13 is effectively prevented.

In the single-color print mode, the transport belt 13 is tilted downward to move away from the photosensitive drums 21C to 21Y whose rotations are stopped. This prevents the transportation of the recording sheet S from being adversely affected.

Figure 3:
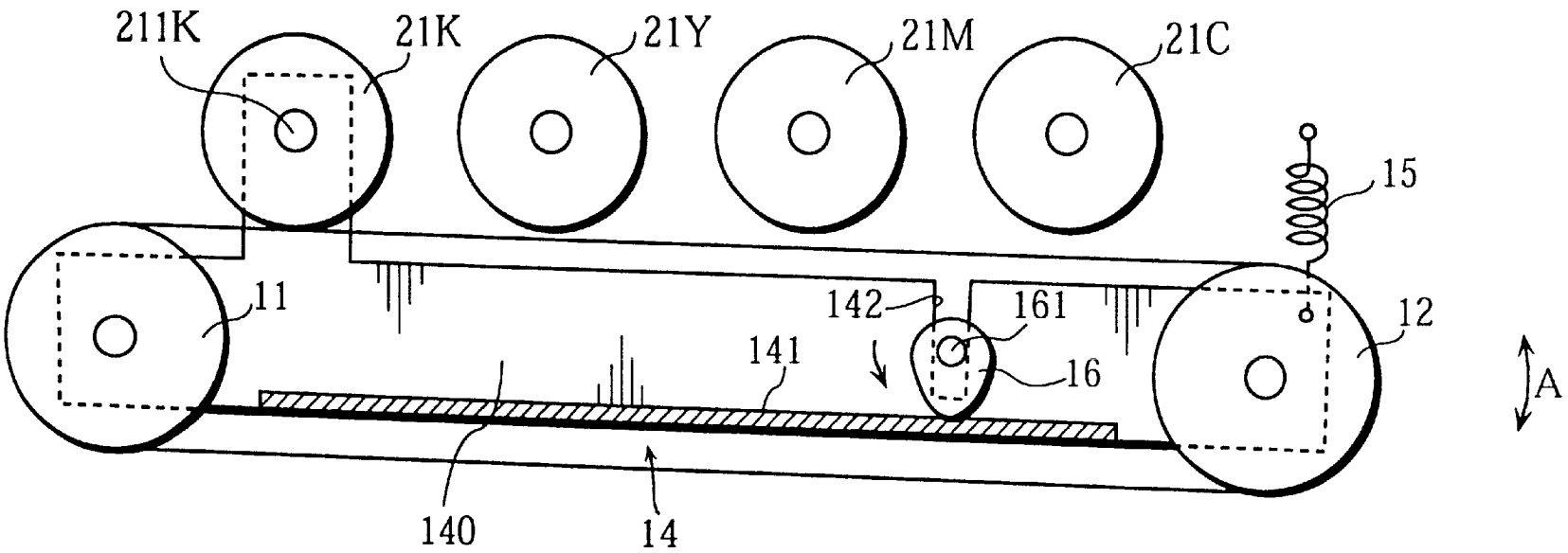
FIG. 3 shows the construction of a transport belt withdrawing mechanism of the image forming section.

FIG. 3 shows an example construction of a withdrawing mechanism which separates the transport belt 13 from the photosensitive drums 21C to 21Y.

The axes of the drive roller 11 and the slave roller 12 are held between side plates 140 of a shift frame 14 to freely rotate via bearings. For ease of explanation, FIG. 3 shows a sectional view of the shift frame 14 cut at the central part of each axis of the drive roller 11 and the slave roller 12 in the axial direction. The shift frame 14 can rotate about a rotational axis 211K of the photosensitive drum 21K in the direction of the arrow A in FIG. 3.

The shift frame 14 is pulled upward by a tensile spring 15 provided on the right part (as the copier is viewed in FIG. 3) of the shift frame 14. The upper surface of a base plate 141 of the shift frame 14 is in contact with the circumferential surface of a cam plate 16. When the cam plate 16 is rotated by a belt withdrawing motor M5 shown in FIG. 2, the shift frame 14 is shifted in the direction of the arrow A and the transport belt 13 is either separated (or withdrawn) from or pressed against the photosensitive drums 21C to 21Y. Note that a notch 142 is provided so that a drive shaft 161 of the cam plate 16 does not interfere with the shift operation of the shift frame 14.

Two limit switches are respectively provided above and below the right part (as the copier is viewed in FIG. 3) of the shift frame 14 and turned on in each corresponding state, that is, a state where the transport belt 13 is pressed against the photosensitive drums 21C to 21Y (referred to as the "pressing state" hereinafter) and a state where the transport belt 13 is moved away from the photosensitive drums 21C to 21Y (referred to as the "withdrawn state" hereinafter). The control unit 50 can easily judge the current state of the transport belt 13 by detecting an output signal from either of the two limit switches.

It should be noted here that the transfer rollers 26C to 26K shown in FIG. 2 are also set on the shift frame 14 and shifted together with the shift frame 14. As such, the relative position of the transfer rollers 26C to 26K and the transport belt 13 is maintained constant.

Since the shift frame 14 is rotated about the rotational axis 211K of the photosensitive drum 21K, the transport belt 13 is always pressed against the photosensitive drum 21K without being affected by the shift operation of the shift frame 14. However, the transfer position of the photosensitive drum 21K is slightly shifted to the left (as the copier is viewed in FIG. 3) when the shift frame 14 is shifted downward. For this reason, the control unit 50 controls the timing of image writing by a scanning unit on the photosensitive drum 21K in the sub-scanning direction to be delayed by the period of time corresponding to the shifted distance.

The transport belt 13 is made up of a material which is a semi-conductive material, such as an ethylene tetrafluoroethylene copolymer (ETFE) and a polycarbonate (PC), whose resistance is $10^8$ Ω to $10^{12}$ Ω to achieve the self-elimination of static. Accordingly, no static eliminator is needed for eliminating the electrostatic charge of the transport belt 13. This contributes to cost reduction and to the simplification of the apparatus.

In the single-color print mode, the transfer rollers 26C to 26Y of the image forming units 20C to 20Y which are not used for forming the image are inoperative. As such, the electrostatic attraction of the transport belt 13 is considerably reduced before the recording sheet S that was charged by the attraction charger 32 reaches the transfer position of the photosensitive drum 21K.

Figure 4A:
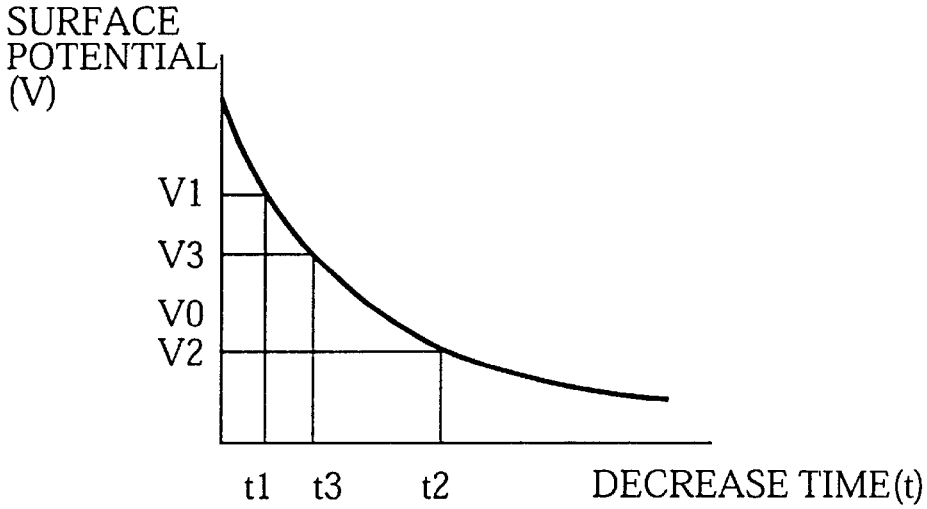
FIGS. 4A and 4B respectively show the decrease of the surface potential and electrostatic attraction of the transport belt due to the self-elimination of static by transport belt.
Figure 4B:
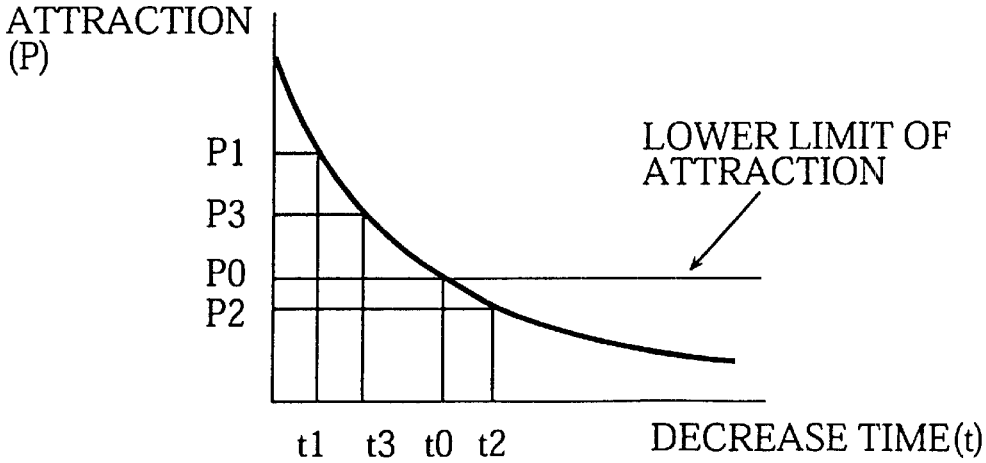

FIG. 4A is the graph showing the decrease in the surface potential V of the transport belt 13 due to the self-elimination of static over time. As the surface potential decreases, so does the attraction of the recording sheet S relative to the transport belt 13, as shown in FIG. 4B. Suppose that a lower limit of the attraction by which the recording sheet S can be securely attracted and transported is P0 (i.e., when the surface potential of the transport belt 13 is V0), and that the time taken from the charging by the attraction charger 32 to a point where the attraction of the transport belt 13 decreases to P0 is to. When the copier is operated in the single-color print mode, the recording sheet S needs to reach the position of the transfer roller 26K before the period of time t0 elapses. Otherwise, the recording sheet S may move away from the correct position on the transport belt 13 so that the image is not formed at the correct position of the recording sheet S. There is also the risk that the recording sheet S may become separated from the surface of the transport belt 13. In particular, when the leading edge of the recording sheet S is separated from the surface of the transport belt 13, the recording sheet S will not be able to smoothly enter the transfer position of the photosensitive drum 21K, causing a paper jam.

To prevent this, the running speed (referred to as the "system speed" hereinafter) of the transport belt 13 is increased, making the period of time for the recording sheet S to pass from the attraction charger 32 to the photosensitive drum 21K equal to or below to in the present embodiment. In addition, the rotation speeds of the photosensitive drum 21K, a developing roller of the developing unit 25K, and a fixing roller 34 of the fixing device 33 are increased through appropriate control.

Consequently, the transport belt 13 is recharged by the transfer roller 26K before the period of time t0 elapses, so that a smooth print operation is realized, with the attraction being maintained equal to or higher than P0.

It should be noted here that the increase in the system speed is limited to a predetermined extent to ensure that the toner images are properly superimposed and no color displacement occurs in the full-color print mode. In the single-color print mode, on the other hand, the increase in the system speed to the extent as described above causes no deterioration of the transferred image since only the transportation precision at the transfer position of the photosensitive drum 21K needs to be considered.

(2) Construction and Control Operation of Control Unit 50

Figure 5:
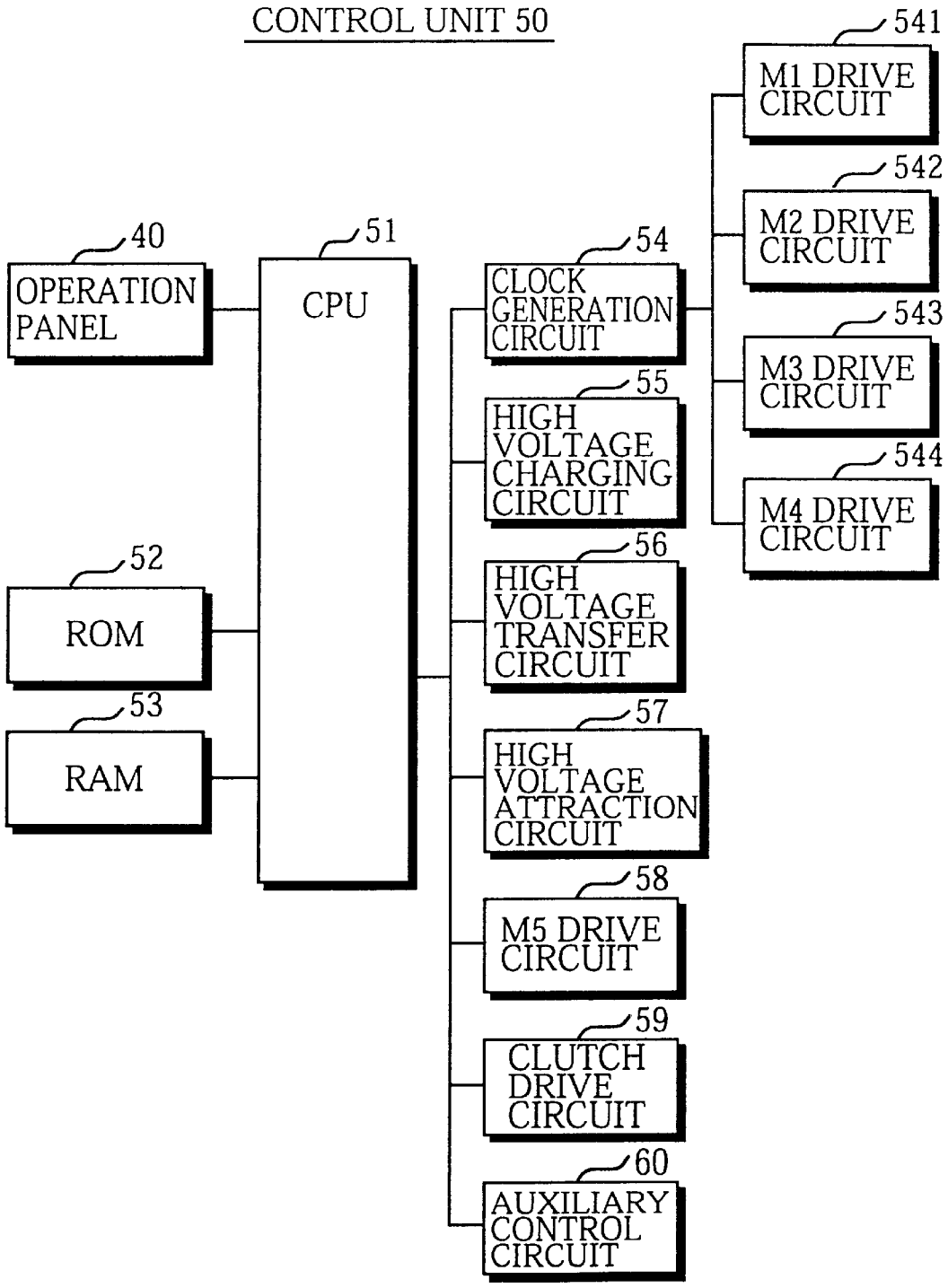
FIG. 5 is a block diagram showing a control unit provided in the full-color image forming apparatus.

The following is a description of the construction of the control unit 50, with reference to FIG. 5.

As shown in FIG. 5, the control unit 50 is composed of a CPU 51, a ROM 52, a RAM 53, a clock generation circuit 54, a high voltage charging circuit 55, a high voltage transfer circuit 56, a high voltage attraction circuit 57, a belt withdrawing motor M5 drive circuit 58, a clutch drive circuit 59, an auxiliary control circuit 60, and motor drive circuits 541 to 544 for respectively driving the stepping motors M1 to M4.

The ROM 52 stores programs required for the various control operations for image formations of the copier. The RAM 53 temporarily stores various control variables and present settings, such as the print mode, that have been inputted from the operation panel 40.

The clock generation circuit 54 receives a drive signal and a speed control signal from the CPU 51 and generates an input clock for each motor corresponding to a system speed V1 in the full-color print mode or a system speed V2 in the single-color print mode. The clock generation circuit 54 then sends the input clock to the corresponding motor drive circuits 541 to 544.

On receiving the input clock, the motor drive circuits 541 to 544 respectively change exciting magnetical phases of the corresponding stepping motors M1 to M4 to give drive pulses and then have the stepping motors M1 to M4 rotate at a predetermined speed.

The high voltage charging circuit 55 and the high voltage transfer circuit 56 apply a predetermined voltage to the sensitizing chargers 24C to 24K and the transfer rollers 26C to 26K in the full-color print mode, and apply the predetermined voltage only to the sensitizing charger 24K and the transfer roller 26K in the single-color print mode.

The high voltage attraction circuit 57 applies a predetermined voltage to the attraction charger 32.

The belt withdrawing motor M5 drive circuit 58 drives the belt withdrawing motor M5 to switch between the pressing state and the withdrawn state of the transport belt 13 in accordance with the set print mode.

The clutch drive circuit 59 controls ON/OFF of each of the electromagnetic clutches respectively set on the driving force transmission paths to the photosensitive drums 21C to 21Y and to the developing units 25C to 25Y in accordance with the set print mode.

The auxiliary control circuit 60 controls various other operations, such as an operation performed by the image reading unit, a display operation performed by a display unit of the operation panel 40, and an operation performed by the scanning unit.

The CPU 51 reads a necessary program from the ROM 52 and executes a smooth print operation by controlling the components in accordance with the appropriate timing.

Figure 6:
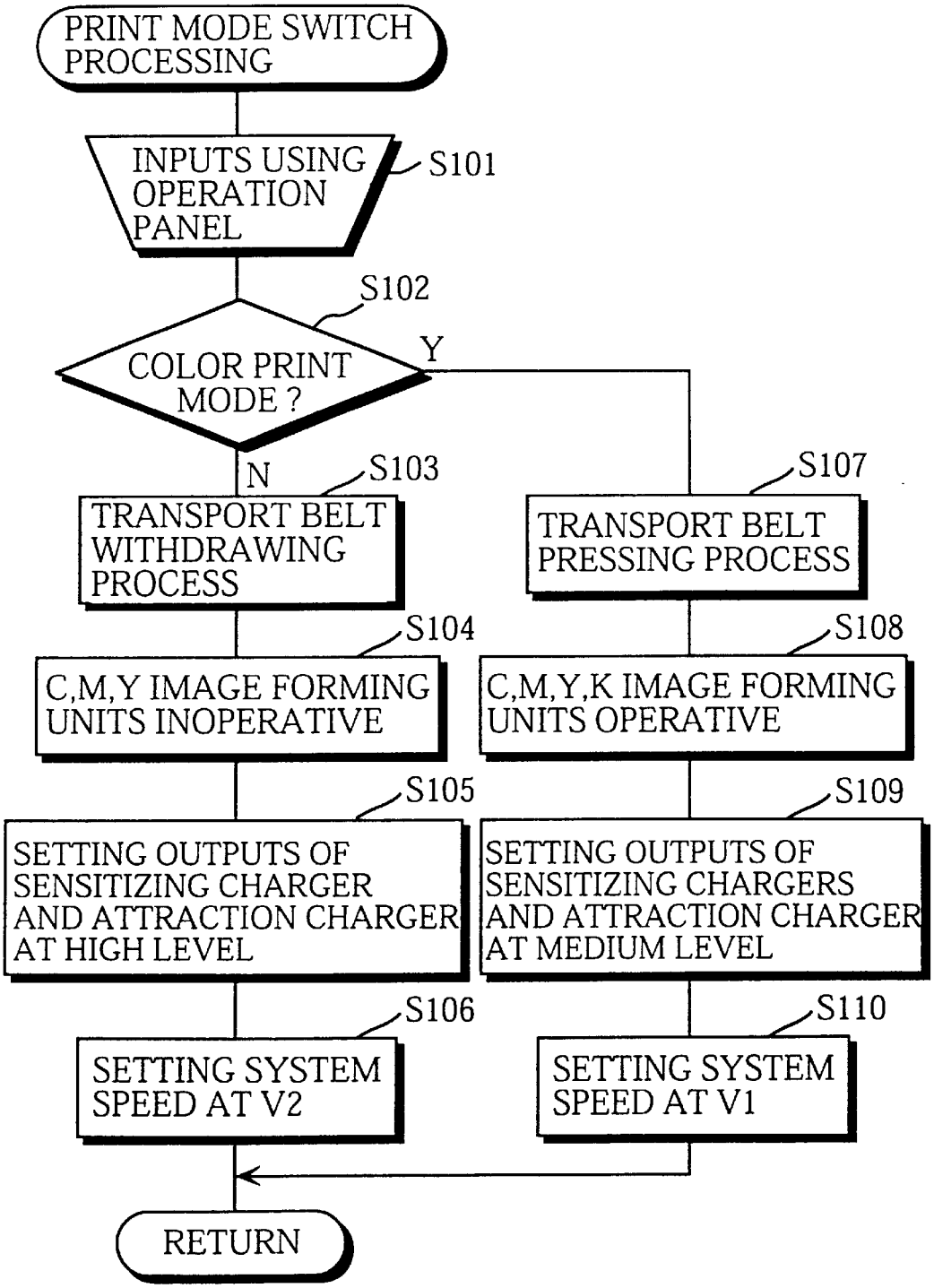
FIG. 6 is a flowchart showing the control operation of the print mode switch processing performed by the control unit of the first embodiment.

Next, the control operation for the print mode switch processing performed by the control unit 50 is explained, with reference to the flowchart of FIG. 6.

The user inputs the print mode, the number of copies, and other settings using the operation panel 40, and presses a start key after setting a document on the image reading unit (step S101). The CPU 51 judges from the settings whether the full-color print mode is set (step S102). If not, the CPU 51 executes the transport belt withdrawing process, so that the single-color print mode is operative (step S103). When doing so, the CPU 51 detects the current state of the transport belt 13. If the transport belt 13 is not in the withdrawn state, the CPU 51 drives the belt withdrawing motor M5 to set the transport belt 13 to the withdrawn state.

Then, the CPU 51 makes the image forming units 20C to 20Y which are not used for forming the image inoperative. Simultaneously, the sensitizing chargers 24C to 24Y are also made inoperative. The CPU 51 has only the image forming unit 20K operative and sets outputs of the sensitizing charger 24K and the attraction charger 32 at a high level (steps S104 and S105), as well as setting the system speed at V2 (step S106).

As described above, the system speed V2 is set to make the period of time for the recording sheet S to pass from the attraction charger 32 to the transfer position of the photosensitive drum 21K below t0 shown in FIG. 4B. Although the period of time t0 naturally changes depending on the electric conductivity of the material used as the transport belt 13 and on the bias voltage of the attraction charger 32, the system speed V2 is set at 300 mm/second in the present embodiment, with the stated conditions being considered.

It should be noted here that the bias voltages of the sensitizing charger 24K and the attraction charger 32 are increased together with the increase in the system speed. This is performed to ensure that the amount of the electrostatic charge per unit area applied to the photosensitive drum 21K and the transport belt 13 in the single-color print mode does not fall below the amount in the full-color print mode and so cause a decrease in image density. Here, a precalculated high bias voltage value is set in the high voltage charging circuit 55 and the high voltage attraction circuit 57, which apply the high bias voltage to the sensitizing charger 24K and the attraction charger 32 when so instructed by the CPU 51.

Together with the increase in the system speed, the scanning speed of the laser beam LK and the rotation speed of the fixing roller 34 of the fixing device 33 need to be increased. Also, it is desirable to set the bias voltage of the transfer roller 26K by the high voltage transfer circuit 56 at high level, so that density of the transferred image is properly maintained.

When judging that the full-color print mode is set in step S102, the CPU 51 executes the transport belt pressing process (step S107). In this process, the CPU 51 judges the current state of the transport belt 13. If the transport belt is in the withdrawn state, the CPU 51 drives the belt withdrawing motor M5 to set the transport belt 13 in the pressing state.

The CPU 51 then makes all of the image forming units 20C to 20K including the transfer rollers 26C to 26K operative and sets the outputs of the sensitizing chargers 24C to 24K and the attraction charger 32 at the medium level, i.e., the same level as in a conventional color print operation (steps S108 and S109). The CPU 51 also sets the system speed at V1 (step S110).

In the present embodiment, the system speed V1 is set at 150 mm/second, at which no color displacement occurs in the transferred color image.

After this print mode switch processing, the CPU 51 returns to the main routine (not shown) and executes the print operation.

Accordingly, the period of time for the recording sheet S to pass from the attraction charger 32 to the transfer position of the photosensitive drum 21K is reduced by using the increased system speed in the single-color print mode. This is to say, the recording sheet S reaches the transfer position of the photosensitive drum 21K before its attraction to the transport belt 13 drops to the lower limit due to the self-elimination of static by the transport belt 13. As a result, the toner image is transferred onto the recording sheet S at the correct position and no paper jam occurs. In addition, the processing speed in the single-color print mode can be increased, compared with the conventional copier.

Second Embodiment

In the first embodiment, the system speed is increased in the single-color print mode to reduce the number of charging operations and to solve the problem of faulty transportation of the recording sheet S. In the second embodiment, meanwhile, an auxiliary attraction device is provided to solve the same problem without increasing the system speed in the single-color print mode.

Figure 7:
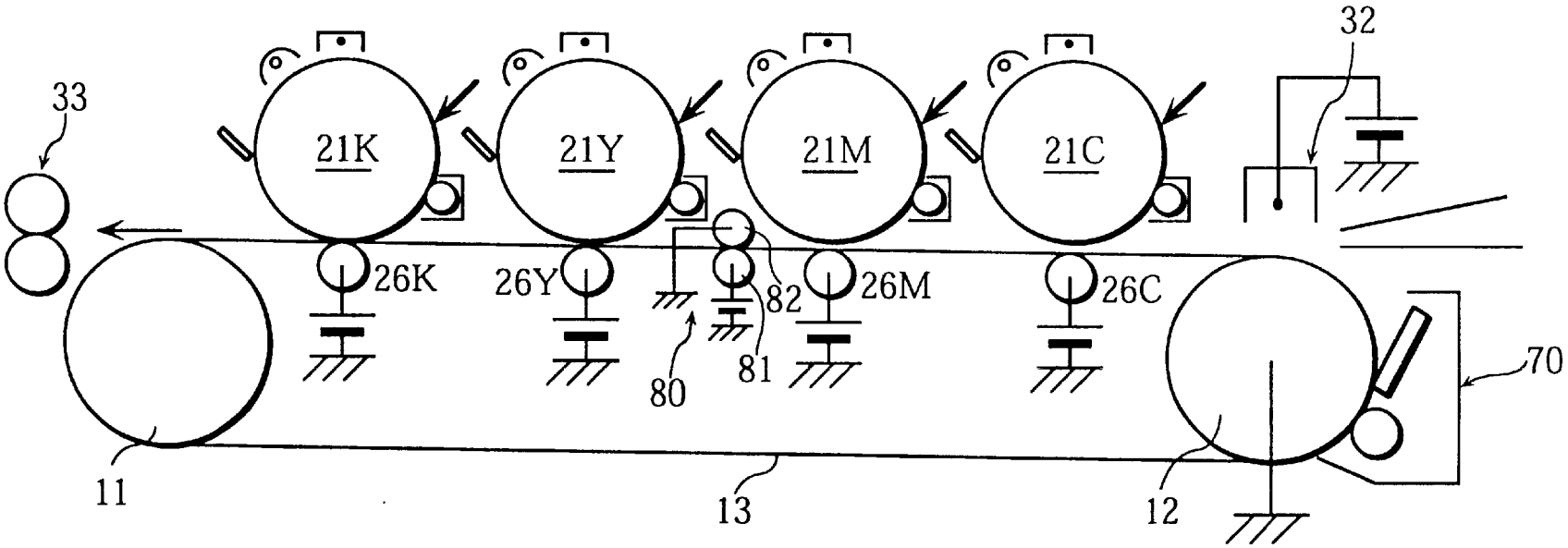
FIG. 7 shows the construction of an image forming section provided in a tandem-type full-color image forming apparatus of the second embodiment of the present invention.

FIG. 7 shows the construction of the image forming section provided in the copier of the second embodiment. In FIG. 7, the transport belt 13 is in the withdrawn state in the single-color print mode. The same components as in the first embodiment are assigned the same numerals as in FIG. 2, and so will not be explained. In addition, the drive motors M1 to M5 are not illustrated in FIG. 7.

As shown in FIG. 7, an auxiliary attraction device 80 is set on a central part between the photosensitive drum 21M and the photosensitive drum 21Y. The auxiliary attraction device 80 holds the recording sheet S and the transport belt 13 passing by this part using an auxiliary charging roller 81 and a supporting roller 82, and charges the recording sheet S and the transport belt 13 to replenish the electrostatic attraction. As a result, the recording sheet S is securely transported to the transfer position of the photosensitive drum 21K without moving away from the correct position on the transport belt 13. In addition, the number of charges in one image formation in the single-color print mode is three including one charge by the attraction charger 32, so that the lifespan of the transport belt 13 can be increased, compared with that of the transport unit of a conventional copier which is charged five times.

Figure 8:
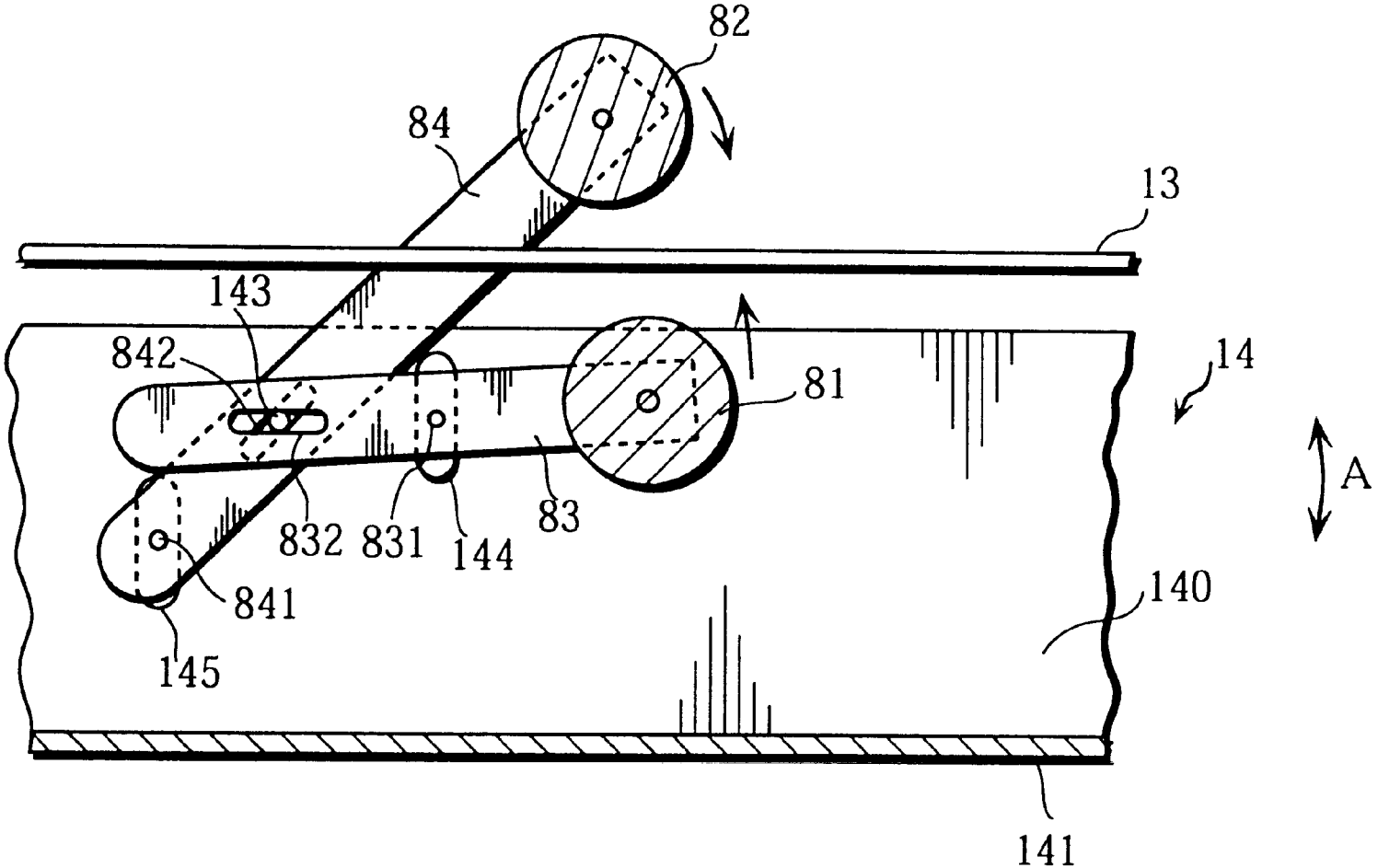
FIG. 8 shows the construction of a holding equipment of an auxiliary charging roller.

FIG. 8 shows an enlarged view of the construction of a holding equipment composed of the auxiliary charging roller 81 and the supporting roller 82 of the auxiliary attraction device 80.

Respective ends of the auxiliary charging roller 81 and the supporting roller 82 are respectively held by pair of arms 83 and 84. The pair of arms 83 and 84 are mounted on fixed frames (not illustrated) provided outside the side plates 140 with pair of pins 831 and 841, with the pair of pins 831 and 841 passing through pair of rounded rectangular holes 144 and 145 provided on the shift frame 14.

A pair of pins 143 set on the side plates 140 of the shift frame 14 is held in pair of rounded rectangular holes 832 and 842 which respectively extend in the direction of the length of the pair of arms 83 and 84. In FIG. 8, the shift frame 14 is in the pressing state, in which the auxiliary charging roller 81 and the supporting roller 82 are separated from the surface of the transport belt 13, so that running of the transport belt 13 is not adversely affected. When the mode is changed from the full-color print mode to the single-color print mode, the shift frame 14 is shifted downward. Together with this movement of the shift frame 14, the pair of pins 143 is also shifted downward. As a result, the pair of arms 83 is shifted upward, and the auxiliary charging roller 81 is pushed upward. Also, the pair of arms 84 is shifted downward, and the supporting roller 82 is pushed downward. Consequently, when the shift frame 14 is in the withdrawn state, the auxiliary charging roller 81 and the supporting roller 82 come into contact with the transport belt 13. The transport belt 13 can then be effectively charged.

The length of the pair of arms 83 and 84, the position of each bearing to hold the corresponding axis, and dimensions of the pair of rounded rectangular holes 832 and 842 are determined to ensure that the auxiliary charging roller 81 and the supporting roller 82 reliably hold the transport belt 13 when the shift frame 14 is in the withdrawn state. Here, some play may be provided in each axis bearing and each rounded rectangular hole. In this case, a tensile component, such as a spring, may also be respectively provided to energize the pair of arms 83 and 84 toward the transport belt 13. As a result, this pressing action of the auxiliary charging roller 81 and the supporting roller 82 can made more stable.

The mechanism which moves the auxiliary charging roller 81 and the supporting roller 82 together with the shift movement of the shift frame 14 is not limited to the stated mechanism. For example, a crank mechanism, an actuator, such as a solenoid, and a cam mechanism may be used.

The construction of the control unit of the second embodiment is almost the same as that shown in FIG. 5, except that another high voltage circuit is added for applying the voltage to the auxiliary charging roller 81. Therefore, the construction of the control unit of the second embodiment is not illustrated.

Figure 9:
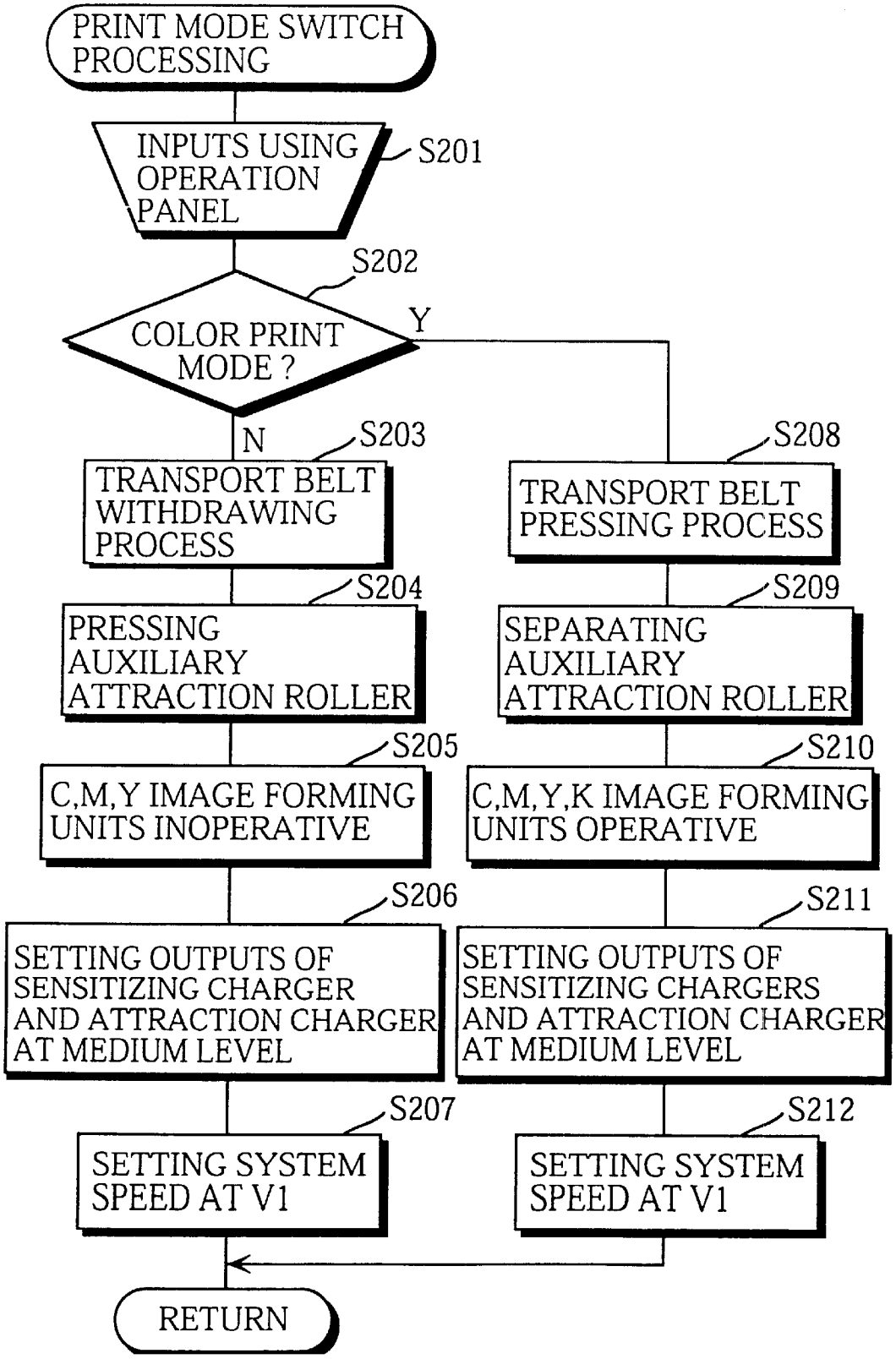
FIG. 9 is a flowchart showing the control operation of the print mode switch processing performed by the control unit of the second embodiment.

FIG. 9 is the flowchart showing the control operation for the print mode switch processing in the second embodiment.

The user inputs the print mode, the number of copies, and the like using the operation panel 40, and presses the start key after setting a document on the image reading unit (step S201). The CPU 51 judges from the present settings whether the full-color print mode is set (step S202). If not, the CPU 51 executes the transport belt withdrawing process, so that the single-color print mode is operative (step S203). When doing so, the CPU 51 detects the current state of the transport belt 13. If the transport belt 13 is not in the withdrawn state, the CPU 51 drives the belt withdrawing motor M5 to set the transport belt 13 to the withdrawn state.

As described above, the CPU 51 has the auxiliary charging roller 81 and the supporting roller 82 press the transport belt 13 from above and underneath together with the shift movement of the shift frame 14, so that the transport belt 13 is charged with electrostatic attraction (step S204).

The CPU 51 makes the image forming units 20C to 20Y including the transfer rollers 26C to 26Y which are not used for forming the image inoperative and makes only the image forming unit 20K operative (step S205). Also, the CPU 51 sets the outputs of the sensitizing charger 24K and the attraction charger 32 at the medium level as well as setting the system speed at the medium speed V1 (steps S206 and S207).

If judging that the full-color print mode is set in step S202, the CPU 51 executes the transport belt pressing process (step S208). When doing so, the CPU 51 detects the current state of the transport belt 13. If the transport belt 13 is in the withdrawn state, the CPU 51 drives the belt withdrawing motor M5 to set the transport belt 13 to the pressing state.

Together with this movement of the shift frame 14, the auxiliary charging roller 81 and the supporting roller 82 are moved away from the transport belt 13 (step S209).

The CPU 51 then makes all of the image forming units 20C to 20K and all of the developing units 25C to 25K operative (step S210). Also, the CPU 51 sets the outputs of the sensitizing chargers 24C to 24K and the attraction charger 32 at the medium level as well as setting the system speed at V1 (steps S211 and S212).

After this print mode switch processing, the CPU 51 returns to the main routine (not shown) for the entire copier and executes the print operation.

In the first embodiment, the system speed is increased in the single-color print mode. On the other hand, in the second embodiment, the attraction of the recording sheet S is maintained above the predetermined level until the recording sheet S reaches the transfer position of the photosensitive drum 21K having the electrostatic attraction increased by the auxiliary attraction device 80 in the single-color print mode, without increasing the system speed. In this way, the image is transferred onto the recording sheet S at the correct position and no paper jam occurs.

It should be noted here that although only one auxiliary attraction device 80 is provided in the present embodiment, two auxiliary attraction devices 80 may be set at the appropriate positions if necessary. In this case, the number of charging operations in one image formation is four and the lifespan of the transport belt 13 still can be increased, compared with that of the transport unit of a conventional copier which is charged five times.

In addition, it is not necessary to use the auxiliary attraction device 80 for all different types of recording sheet in the single-color print mode. For example, charging by the auxiliary attraction device 80 may be performed depending on the electrostatic capacity of the recording sheet. The electrostatic capacity of the recording sheet varies with the material and moisture of the recording sheet. For this reason, the electrostatic attraction charging may be executed or not, depending on the moisture of the recording sheet as well as on the type of the recording sheet.

Third Embodiment

The first and second embodiments have been explained on the premise that a plain sheet which is about 100 $\mu$m to 150 $\mu$m thick is used as the recording sheet. The plain sheet is frequently used as the recording sheet in organizations such as offices.

When a thick sheet or a film sheet for an overhead projector (referred to as the "OHP sheet" hereinafter) is used as the recording sheet, it is desirable to set the system speed at slower than usual to ensure that toner is fixed onto the recording sheet, since more amount of heat is required for fixing toner onto the thick sheet and the OHP sheet.

In this case, it takes much more time for the recording sheet to be transported from the attraction charger 32 to the transfer position of the photosensitive drum 21K in the single-color print mode. In addition, the electrostatic attraction may fall below P0 shown in FIG. 4B, meaning that the possibility of a paper jam increases. This problem can be solved by the third embodiment.

The constructions of the image forming section and the control unit in the third embodiment are almost the same as those of the first embodiment. In the third embodiment, a sheet-type input unit (not illustrated) is provided on the operation panel 40 for the case when the OHP sheet or the thick sheet is used as the recording sheet, and the control operation for the print mode switch processing by the control unit 50 is different from that in the first embodiment.

Figure 10:
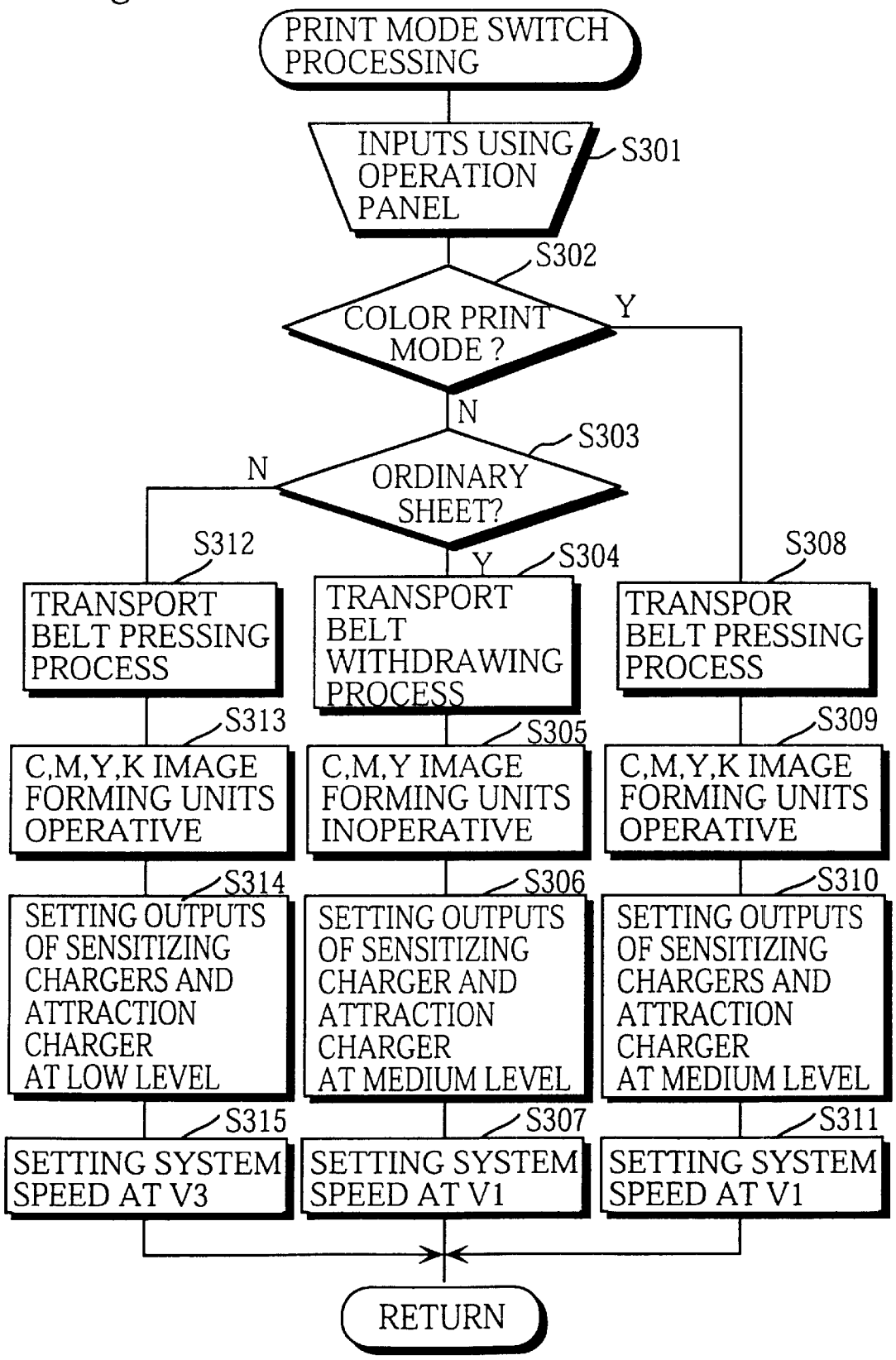
FIG. 10 is a flowchart showing the control operation of the print mode switch processing performed by the control unit of the third embodiment.

Therefore, the explanation of the constructions of the image forming section and the control unit are omitted in the present embodiment, and the print mode switch processing unique to the third embodiment is described, with reference to the flowchart of FIG. 10.

The user inputs the print mode, the number of copies, and the sheet-type (OHP sheet, for example) using the operation panel 40, and presses the start key after setting a document on the image reading unit (step S301). The CPU 51 judges whether the full-color print mode is set (step S302). If not, the CPU 51 next judges whether the recording sheet to be used is the plain sheet (step S303). This judgement is made in accordance with the present settings of the operation panel 40. If the OHP sheet is not set, the CPU 51 judges that the plain sheet is used as the recording sheet.

If the recording sheet is judged to be the plain sheet, the CPU 51 executes the transport belt withdrawing process to set the transport belt 13 to the withdrawn state (step S304), so that the single-color print mode is operative.

The CPU 51 makes the image forming units 20C to 20Y including the transfer rollers 26C to 26Y which are not used for forming the image inoperative and makes only the image forming unit 20K operative (step S305). Also, the CPU 51 sets the outputs of the sensitizing charger 24K and the attraction charger 32 at the medium level which is the same level as in the conventional color print operation, as well as setting the system speed at the medium speed V1 (steps S306 and S307).

If judging that the recording sheet is not judged to be the plain sheet in step S303, the CPU 51 proceeds to step S312 to set the transport belt 13 to the pressing state (step S312) and makes all of the image forming units 20C to 20K including the transfer rollers 26C to 26K operative (step S313).

When doing so, the CPU 51 sets the outputs of the sensitizing chargers 24C to 24K and the attraction charger 32 at a lower level than the level in the conventional color print operation (step S314) as well as setting the system speed at the low speed V3 (step S315).

The system speed V3 is set at about 100 mm/second at which a certain number of the recording sheets can be sequentially transported, in consideration of a heating value of the fixing device and amount of heat required for fixing toner onto the OHP sheet or the thick sheet.

The amount of the electrostatic charge applied to the photosensitive drums and the transport belt 13 per unit area in per unit of time is higher than in the case when the plain sheet is used. Therefore, the outputs of the sensitizing chargers 24C to 24K and the attraction charger 32 are set at the lower level together with the decrease in the system speed to prevent the density of the transferred image becoming higher. The output level is previously set at an appropriate value through experiments.

Together with the decrease in the system speed, the scanning speed of the laser beams LC to LK and the rotation speed of the fixing roller 34 of the fixing device 33 need to be decreased. Also, it is desirable to set the bias voltage applied to the transfer roller 26K by the high voltage transfer circuit 56 at a lower level, so that the density of the transferred image is properly maintained.

When judging that the full-color print mode is set in step S302, the CPU 51 executes the transport belt pressing process (step S308) to set the transport belt 13 to the pressing state.

The CPU 51 then makes all of the image forming units 20C to 20K including the transfer rollers 26C to 26K operative (step S309). Also, the CPU 51 sets the outputs of the sensitizing chargers 24C to 24K and the attraction charger 32 at the medium level as well as setting the system speed at the medium speed V1 (steps S310 and S311). In this way, the full-color image is formed.

In the third embodiment as described above, when the single-color print mode is operative and the OHP sheet or the thick sheet is used as the recording sheet, the CPU 51 sets the system speed at the low speed V3 and sets the shift frame 14 in the pressing state to make all of the image forming units 20C to 20K operative. This ensures that the recording sheet is reliably attracted to the transport belt 13. In this way, the bias voltage is respectively applied to the transfer rollers 26C to 26Y which are usually inoperative in the single-color print mode, so that the electrostatic attraction is increased.

Consequently, the recording sheet which has been attracted to the transport belt 13 by the attraction charger 32 is reliably transported to the transfer position of the photosensitive drum 21K, with the attraction of the recording sheet being maintained above the predetermined level. As a result, the image is transferred onto the recording sheet at the correct position, and no paper jam occurs.

Compared with the plain sheet, the OHP sheet and the thick sheet are not used so often. When the plain sheet is used in the single-color print mode, the number of charges in one image formation is two. Therefore, the lifespan of the transport belt 13 can be increased, compared with that of the transport unit of a conventional copier which is charged five times.

Although all of the image forming units 20C to 20K are made operative in the single-color print mode when the OHP sheet or the thick sheet is used, the scanning units of the image forming units 20C to 20Y, the eraser lamps 23C to 23Y, and the sensitizing chargers 24C to 24Y do not need to be made operative. Alternatively, the appropriate increase in the electrostatic attraction can be achieved by using at least one of the transfer rollers 26C to 26Y operating at a predetermined output level. In this case, it is effective to use the transfer roller 26M which is located at almost the central part between the attraction charger 32 and the photosensitive drum 21K.

In the present embodiment, although the user inputs the sheet-type using the operation panel 40, the mode may be automatically determined by detecting the type of a supplied sheet. For example, a sensor, such as a limit switch, may be set on a manual tray which is provided separately from a sheet supply cassette and from which the OHP sheet and the thick sheet are usually supplied. By means of this sensor, the recording sheet set on the manual tray may be detected, and the OHP sheet or the thick sheet is judged to be used as the recording sheet.

In the stated embodiments except for the case when the OHP sheet (or, the thick sheet) is used as the recording sheet in the third embodiment, the transport belt 13 is moved away from the photosensitive drums 21C to 21Y which are not used for forming the image and the image forming units 20C to 20Y are made inoperative in the single-color print mode. As a result, unnecessary abrasion of these components are prevented. However, it is not necessary to perform this withdrawing operation only to increase the lifespan of the transport belt 13 by reducing the number of charging operations. For example, the CPU 51 may control the photosensitive drums 21C to 21K to rotate, with the transport belt 13 being in contact with the photosensitive drums 21C to 21K, and may control the transfer rollers 26C to 26Y not to output.

In the stated embodiments, the shift frame 14 which holds the slave roller 12 via the bearings is shifted upward and downward by the cam equipment, so that the transport belt 13 is pressed against and moved away from the photosensitive drums 21C to 21Y which are not used for forming the image in the single-color print mode. However, the equipment for shifting the shift frame 14 is not limited to this cam equipment, and one of other various actuators may be used. In addition, the photosensitive drums 21C to 21Y may be shifted upward to move away from the transport belt 13 instead of the movement of the transport belt 13.

Moreover, although the user inputs the print mode using the operation panel 40, a document judging unit, for example, may be provided for judging that each document is color or black-and-white based on the image data of the document read by the image reading unit. In accordance with the judgement result, the print mode may be automatically set. For judging whether the document is color or black-and-white, the CPU 51 may obtain Chroma (C*) data for each pixel from the R, G, and B image data obtained by the image reading unit, and count the number of pixels which include a predetermined Chroma (C*). If the ratio of the number of chromatic pixels to the number of pixels in the page is equal to or higher than a predetermined ratio (for example, 0.1%), the document may be judged to be a color document.

Fourth Embodiment

Figure 11:
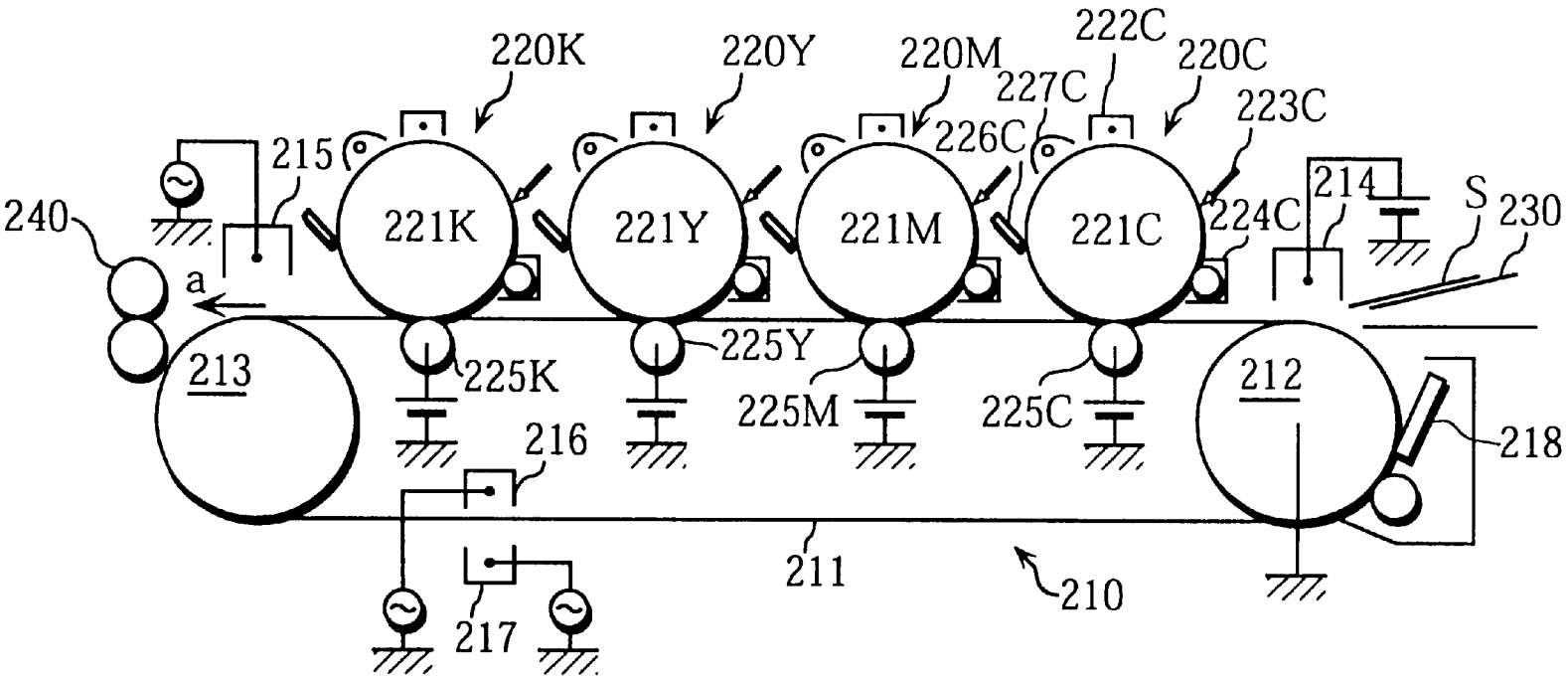
FIG. 11 shows the construction of an image forming section provided in a tandem-type full-color image forming apparatus of the fourth embodiment of the present invention.

FIG. 11 shows the image forming section of the copier of the fourth embodiment. As shown in FIG. 11, the image forming section is roughly composed of a transport belt unit 210, four image forming units 220C, 220M, 220Y, and 220K, and a fixing roller 240. A recording sheet S is transported by a transport belt 211 which are horizontally set in a lower space of an enclosure of the copier. The image forming units 220C to 220K are set above the transport belt 211 along its length and transfer toner images onto the recording sheet S to form a color image, with the toner images being superimposed. As in the cases of the stated embodiments, by using the operation panel (not illustrated), the user can select between the full-color print mode where a color image is formed using four color toner and the single-color print mode where a black image is formed using only black toner.

The transport belt unit 210 is composed of the transport belt 211, a slave roller 212 for extending and revolving the transport belt 211, a drive roller 213, an attraction charger 214, a separating charger 215, an electrical eliminating chargers 216 and 217, and a belt cleaner 218. The attraction charger 214 applies electrostatic charge to the transport belt 211 and the recording sheet S to ensure that the recording sheet S is electrostatically attracted to the transport belt 211. The separating charger 215 eliminates the electrostatic charge of the recording sheet S and separates the recording sheet S from transport belt 211, while the electrical eliminating chargers 216 and 217 eliminate the electrostatic charge of the transport belt 211. The belt cleaner 218 removes toner particles and the like remaining on the surface of the transport belt 211.

The transport belt 211 is made of a film-base belt whose material is polyvinylidene fluoride (PVDF) or polycarbonate, or made of a rubber belt whose material is chloroprene rubber or urethane rubber. The material whose volume resistance is $10^8$ Ω·cm to $10^{16}$ Ω·cm can be used as the transport belt 211. It should be noted here that it is highly effective particularly when a semi-conductive transport belt whose volume resistance is $10^8$ Ω·cm to $10^{12}$ Ω·cm is used for the present invention. In general, the electrical attraction of the semi-conductive transport belt considerably decreases by an electrostatic charge flow and a hop of the electrostatic charge. In addition, the electrostatic attraction by the high transfer voltage has its limit. As such, by using such a semi-conductive transport belt, the advantage of the present invention that the recording sheet S can be securely attracted to the transport belt 211 by increasing the transfer pressure in the single-color print mode (described later) can be exploited more effectively.

The image forming units 220C to 220K respectively form cyan(C), magenta(M), yellow(Y), and black(K) images. All of the image forming units 220C to 220K have the same construction, and therefore, only the image forming unit 220C is explained as one example. The image forming unit 220C is composed of a photosensitive drum 221C as a main component, a sensitizing charger 222C, an exposure unit 223C, a developing unit 224C, a transfer roller 225C, a cleaner 226C, and an eraser lamp 227C. With this construction, the photosensitive drum 221C is exposed by a light-modulated laser beam, and an electrostatic latent image is formed on the surface of the photosensitive drum 221C. The developing unit 224C develops the electrostatic latent image into a visible toner image using cyan toner. Here, the toner image formed on the surface of the photosensitive drum 221C is negatively charged. The toner image is transferred onto the recording sheet S transported by the transport belt 211 by means of an action of the positive electric field applied by the transfer roller 225C which is provided on the inside of the transport belt 211. Accordingly, the image is formed on the recording sheet S. All of the image forming units 220C to 220K are used for forming the image in the full-color print mode, while only the image forming unit 220K is used and the image forming units 220C to 220Y are not used for forming the image in the single-color print mode. In the single-color print mode, however, the transfer rollers 225C to 225Y of the image forming units 220C to 220Y are applied the same transfer voltage as in the full-color print mode.

Figure 12A:
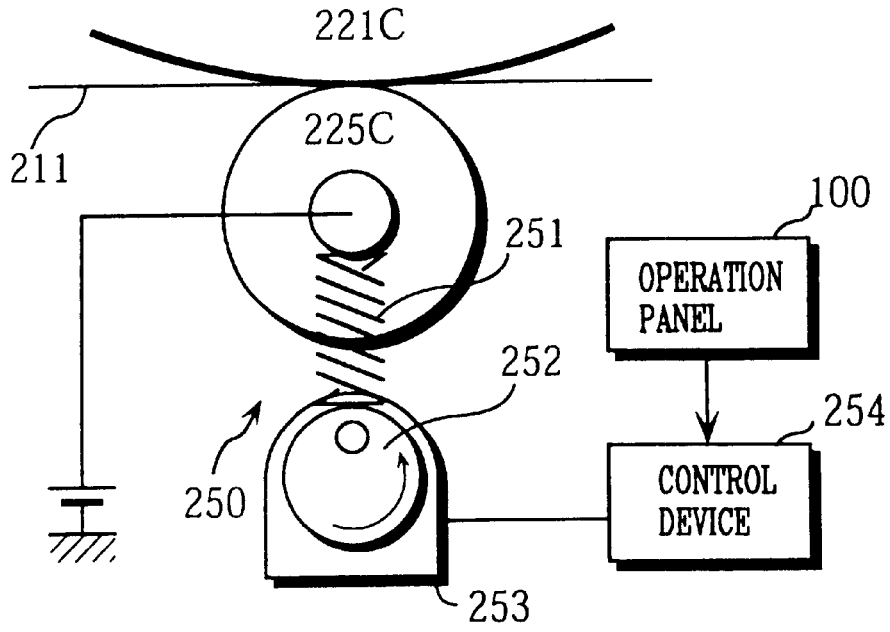
FIG. 12A shows a state where a normal transfer pressure is applied by a transfer pressure increasing equipment of the fourth embodiment.
Figure 12B:
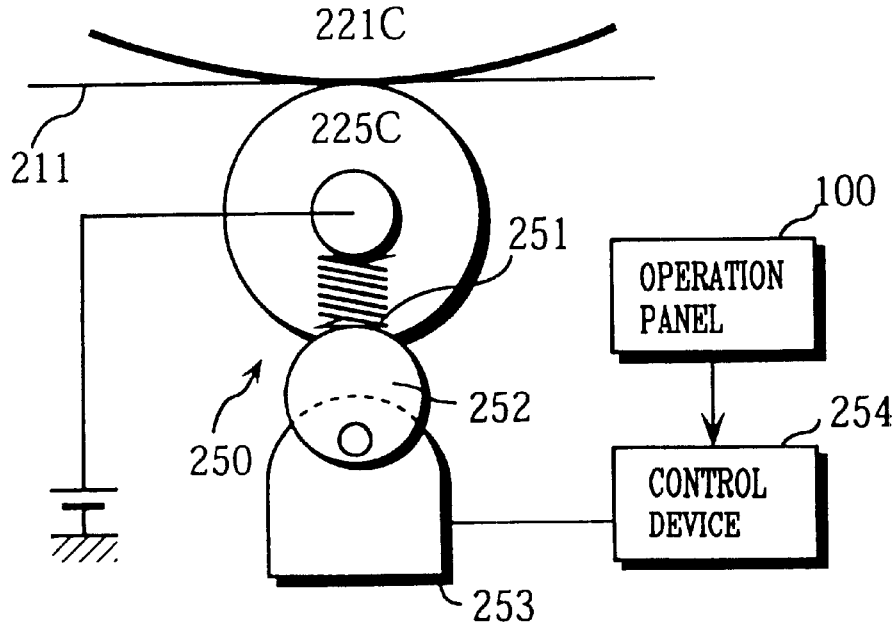
FIG. 12B shows a state where an increased transfer pressure is applied by the transfer pressure increasing equipment of the fourth embodiment.

Each of the transfer rollers 225C to 225K is provided with a transfer pressure increasing equipment for increasing the transfer pressure, i.e., the relative pressure between the recording sheet S and the transport belt 211. FIG. 12A shows the construction of the transfer pressure increasing equipment 250 which is provided for the transfer roller 225C. As shown in FIG. 12A, the transfer pressure increasing equipment 250 is composed of: a spring 251 for pushing the rotational axis of the transfer roller 225C upward; a tension adjusting cam 252 for adjusting the tension of the spring 251; a cam drive device 253 for rotating the tension adjusting cam 252 to switch between the state shown in FIG. 12A and the state shown in FIG. 12B; and a control device 254 for controlling the cam drive device 253. When the tension adjusting cam 252 of the transfer pressure increasing equipment 250 is not currently pushing the spring 251 as shown in FIG. 12A, the transfer roller 225C is pressed against the transport belt 211 by normal force, that is, by normal transfer pressure applied in the full-color print mode. This normal transfer pressure is adjusted to achieve a favorable transfer, so that the transferred image does not suffer from unevenness due to agglomeration of toner particles and that a satisfactory transfer efficiency is obtained. Meanwhile, when the tension adjusting cam 252 of the transfer pressure increasing equipment 250 is currently pushing the spring 251 as shown in FIG. 12B, the transfer roller 225C is pressed against the transport belt 211 by strong force, meaning that the transfer pressure is higher than in the state shown in FIG. 12A.

The control device 254 is composed of a CPU for performing the calculation processing, a RAM for serving as a work area of the CPU, and a ROM for storing programs. The control device 254 receives signals from an operation panel 100 which is used by the user. When receiving a signal indicating that the single-color print mode is set from the operation panel 100, the control device 254 rotates the cam drive devices 253 of the transfer pressure increasing equipments 250 which are respectively set at the transfer positions of the photosensitive drums 221C to 221Y to set the transfer pressure increasing equipments 250 in the state shown in FIG. 12B according to the program stored in the ROM.

The following is a description of the control operation performed in each print mode when the tandem-type copier with the stated construction is used.

The operation for forming a full-color image in the full-color print mode is first explained. In this case, a high-quality sheet for a color image is used as the recording sheet S. Suppose that all of the transfer pressure increasing equipments 250 are in the state shown in FIG. 12A, with the respective transfer pressure being maintained normal.

The recording sheet S is transported to an attracting position by a sheet guide 230 and electrostatically attracted to the transport belt 211 which is charged by the attraction charger 214. With this electrostatic attraction being maintained, the recording sheet S is sequentially transported to each transfer position of the image forming units 220C to 220K as the transport belt 211 revolves. Since the high-quality sheet is used as the recording sheet S, the recording sheet S is electrostatically attracted to the transport belt 211 securely and does not move away from the correct position on the transport belt 211. In synchronization with the timing at which the recording sheet S reaches each transfer position, the C, M, Y, or K toner image is formed on the corresponding one of the photosensitive drums 221C to 221K of the image forming units 220C to 220K in accordance with image signals. Accordingly, the toner images are sequentially transferred onto the recording sheet S. As mentioned above, since the transfer pressure is set at normal, a favorable image is obtained without unevenness incurred by agglomeration of toner particles.

After all of the toner images are transferred onto the recording sheet S, the recording sheet S is separated from the transport belt 211 by the separating charger 215. The toner particles forming the image on the recording sheet S are fused and fixed in place by the fixing roller 240 which includes a heater. After the separation of the recording sheet S, the electrostatic charge of the transport belt 211 is eliminated by the electrical eliminating chargers 216 and 217, and the belt cleaner 218 removes toner particles and the like remaining on the surface of the transport belt 211. As a result, the transport belt 211 returns to a clean state.

Next, the operation for forming a black-and-white image in the single-color print mode is explained. In this case, not only the high-quality sheet, but also a recycled sheet and a low-grade sheet which have rough surfaces can be used as the recording sheet S. The following is a description for the case when the recycled sheet is used as the recording sheet S.

When the user selects the single-color print mode using the operation panel 100, the control devices 254 of the transfer pressure increasing equipments 250 has the cam drive devices 253 set at the transfer positions of the photosensitive drums 221C to 221Y rotate. As a result, each transfer pressure increasing equipment 250 is in the state shown in FIG. 12B, that is, the high transfer pressure is applied. Meanwhile, the transfer pressure increasing equipment 250 set at the transfer position of the photosensitive drum 221K is in the state shown in FIG. 12A, that is, the normal transfer pressure is applied. As described above, the transfer rollers 225C to 225Y of the image forming units 220C to 220Y which are not used for forming the image in the single-color print mode are applied the same transfer voltage as in the full-color print mode.

The recording sheet S is transported to the attracting position by the sheet guide 230 and electrostatically attracted to the transport belt 211. The recording sheet S is transported by the transport belt 211 and passes by the image forming units 220C to 220Y which are not used for forming the image. Here, although the image forming units 220C to 220Y only transport the recording sheet S, the transfer voltage at each transfer position of the image forming units 220C to 220Y is increased by the corresponding transfer pressure increasing equipment 250. Consequently, the friction between the recording sheet S and the transport belt 211 at each transfer position of the image forming units 220C to 220Y is high and an air gap between the recording sheet S and the transport belt 211 is small, so that the high electrostatic attraction of the transport belt 211 relative to the recording sheet S is obtained. Accordingly, the recycled sheet being used as the recording sheet S is securely attracted to the transport belt 211 and reliably transported. This can prevent a skew of the recording sheet S and a paper jam.

The recording sheet S is then transported to the image forming unit 220K, where a black-and-white toner image is formed on the recording sheet S. As described above, the recording sheet S is securely attracted to the transport belt 211, so that the recording sheet S does not move away from the correct position on the transport belt 211. In addition, since the transfer pressure is set at normal, a favorable image is obtained without unevenness incurred by agglomeration of toner particles. After the toner image is transferred onto the recording sheet S, the recording sheet S is finally separated from the transport belt 211 by the separating charger 215 and the toner particles forming the image on the recording sheet S are fused and fixed in place by the fixing roller 240.

Figure 13:
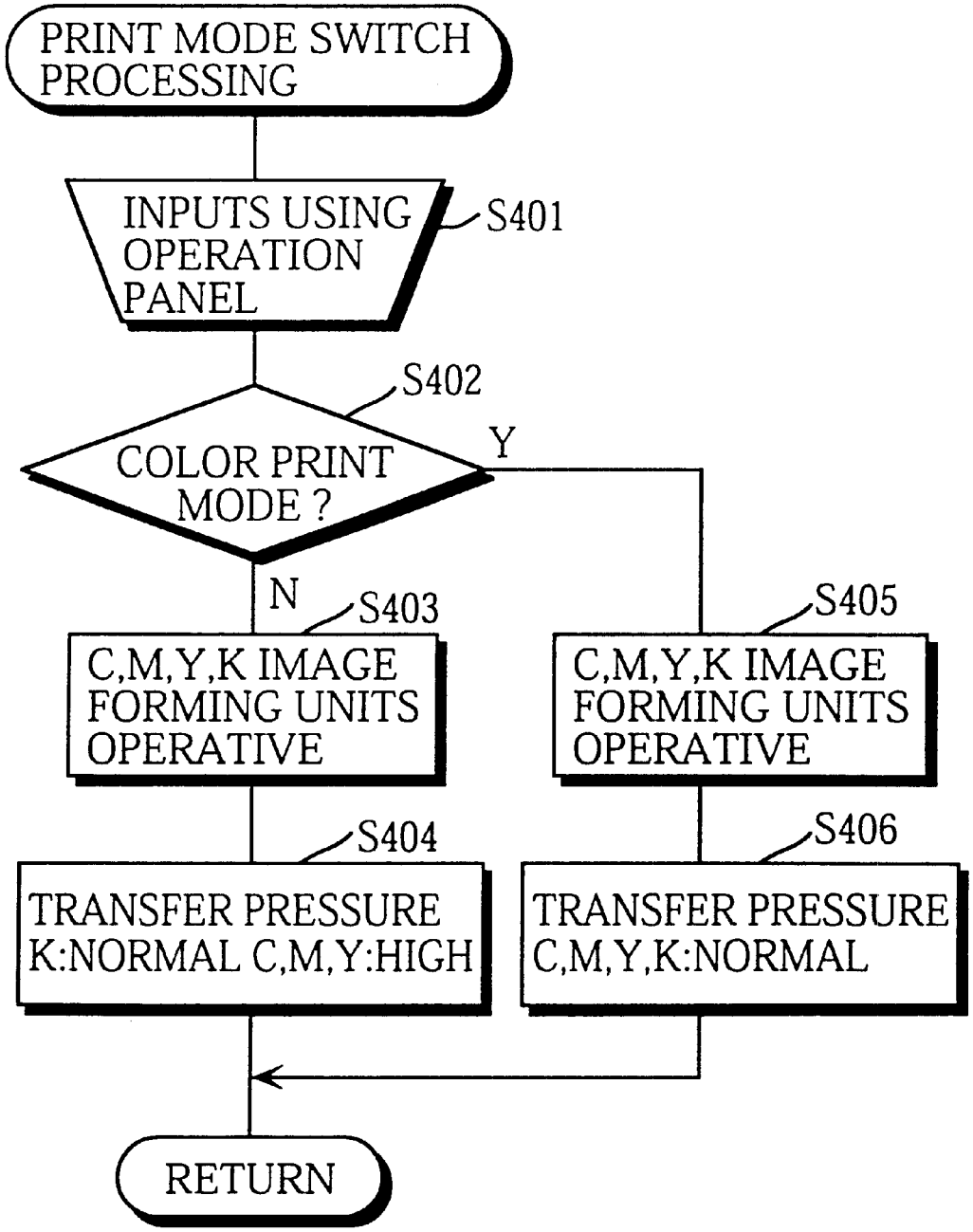
FIG. 13 is a flowchart showing the control operation of the print mode switch processing performed by the control unit of the fourth embodiment.

FIG. 13 is the flowchart of the stated control operation for the print mode switch processing.

When the user sets the print mode using the operation panel 100 (step S401), the control unit 254 judges from the present settings whether the full-color print mode is set (step S402). If not, that is, if the single-color print mode is set, the control unit 254 makes the image forming units 220C to 220K operative (step S403). The control unit 254 then activates the transfer pressure increasing equipments 250 of the image forming units 220C to 220Y which are not used for forming the image to increase the respective transfer voltages as well as keeping the transfer pressure applied to the image forming unit 220K normal (step S404). After this, the control unit 254 returns to the main routine (not shown) of the control operation of the entire copier and executes the black-and-white image formation using only the image forming unit 220K.

Meanwhile, if judging that the full-color print mode is set in step S402, the control unit 254 makes all of the image forming units 220C to 220K operative (step S405). The control unit 254 has the normal transfer pressure applied to all of the image forming units 220C to 220K without activating the transfer pressure increasing equipments 250 (step S406). Then, the control unit 254 returns to the main routine (not shown) and executes the full-color image formation using all of the image forming units 220C to 220K.

It should be noted here that although the transfer pressure is increased by increasing the pushing pressure of the transfer rollers against the transport belt, other methods can be used as long as the transfer pressure is increased by pressing the recording sheet and the transport belt each other.

For example, a transfer charger may be used instead of the transfer roller and an image transfer may be performed by pushing the transport belt toward the photosensitive drum using a press film at the transfer position, so that the transfer pressure can be increased by the press film. Alternatively, a transfer blade may be used for pressing the transport belt against the photosensitive drum at the transfer position when the image transfer is performed, so that the transfer pressure can be increased by the transfer blade.

Fifth Embodiment

Figure 14:
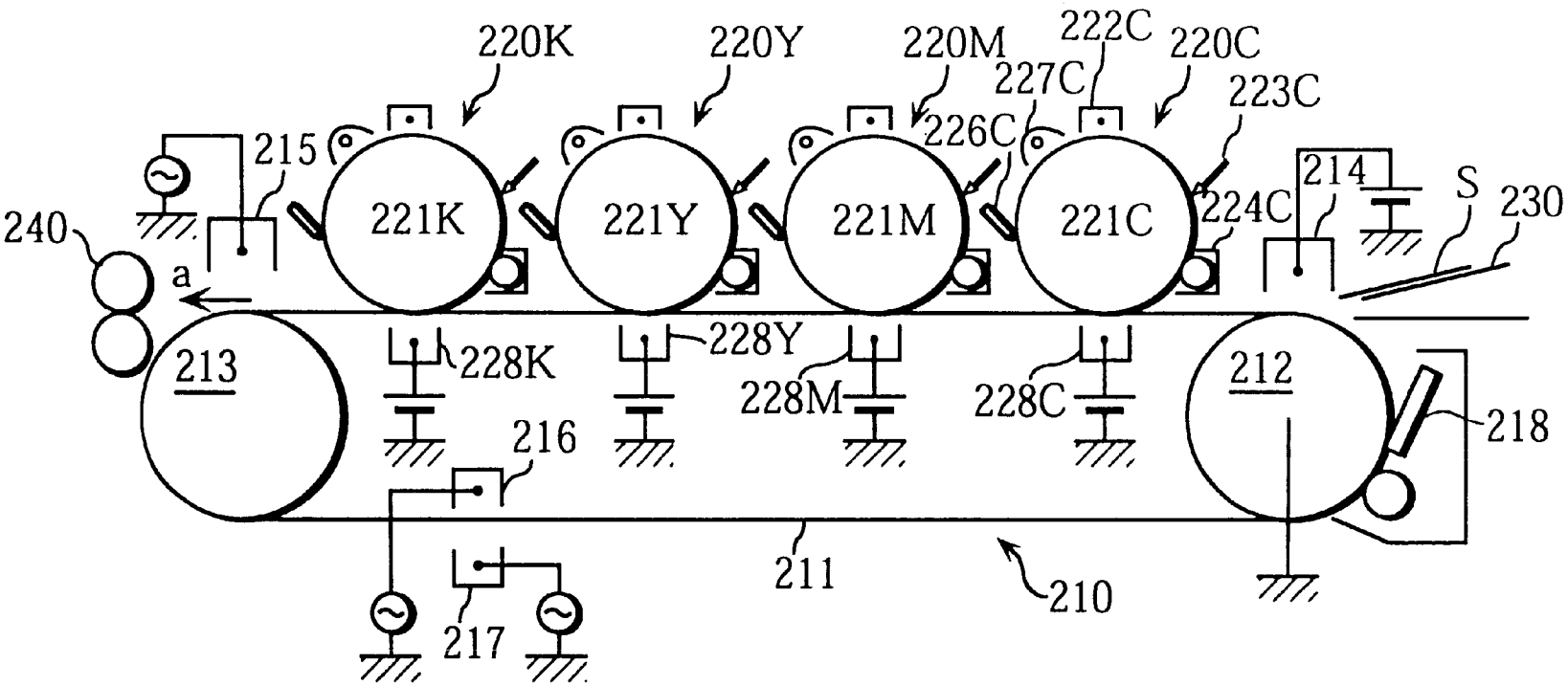
FIG. 14 shows the construction of an image forming section provided in a tandem-type full-color image forming apparatus of the fifth embodiment of the present invention.

FIG. 14 shows the construction of the image forming section of the copier used in the fifth embodiment.

In the fourth embodiment, the transfer rollers are used for charging when the toner image is transferred. Instead of the transfer rollers, transfer chargers 228C to 228K are used in the fifth embodiment. When the single-color print mode is operative, the transfer chargers 228C to 228Y of the image forming units 220C to 220Y which are not used for forming the image are applied the same transfer voltage as in the full-color print mode. Aside from that the transfer chargers 228C to 228K are used instead of the transfer rollers, the construction of the image forming section of the fifth embodiment is the same as that of the fourth embodiment.

The recording sheet S is securely attracted to the transport belt 211 by increasing the transfer pressure of the transfer rollers 225C to 225Y relative to the transport belt 211 in the fourth embodiment. As a general rule, the transfer chargers 228C to 228K are not in contact with the transport belt 211. Therefore, it is desirable to increase the attraction of the recording sheet S relative to the transport belt 211 using a certain method. In the present embodiment, an electric field enlarging equipment 260 is provided for each of the transfer chargers 228C to 228K for increasing the electric field applied to the surface of the transport belt 211.

Figure 15A:
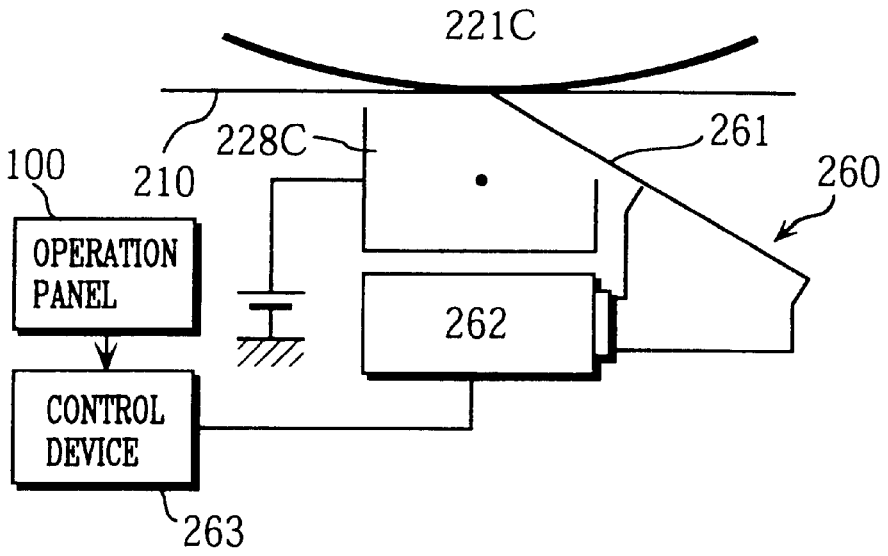
FIG. 15A shows a state where an electric field relative to the transport belt is set normal by an electric field enlarging equipment of the fifth embodiment.

FIG. 15A shows the construction of the electric field enlarging equipment 260 provided for the transfer charger 228C. The electric field enlarging equipment 260 is composed of: an electrostatic charge adjusting component 261 made of a resin film, such as a MYLAR (registered Trademark), for adjusting the electric field applied by the transfer charger 228C relative to the transport belt 211; an adjusting solenoid 262 for adjusting the size of the electric field determined by the electrostatic charge adjusting component 261 by moving the electrostatic charge adjusting component 261 laterally; and a control device 263 for controlling the adjusting solenoid 262. Normally, the electric field enlarging equipment 260 is in the state shown in FIG. 15A, with the adjusting solenoid 262 being in its backmost position. This is to say, the size of the electric field applied by the transfer charger 228 relative to the surface of the transport belt 211 is maintained normal. With this normal size of the electric field, no toner fly-off occurs onto the recording sheet S before an image is transferred.

Figure 15B:
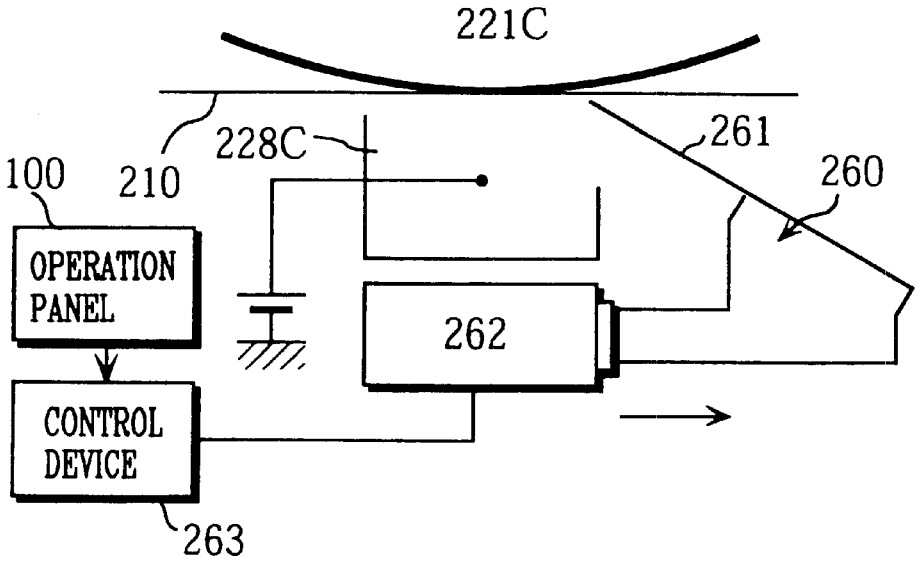
FIG. 15B shows a state where the electric field is enlarged by the electric field enlarging equipment of the fifth embodiment.

Meanwhile, when the adjusting solenoid 262 extends as shown in FIG. 15B, the size of the electric field applied by the transfer charger 228 relative to the surface of the transport belt 211 is enlarged. This is to say, when being transported to the transfer position where the electric field has been enlarged, the recording sheet S is applied the increased attraction by the transfer charger 228.

As is the case with the control device 254 of the transfer pressure increasing equipment 250 of the fourth embodiment, the control device 263 is composed of a CPU for performing the calculation processing, a RAM for serving as a work area of the CPU, and a ROM for storing programs. The control device 263 receives signals from the operation panel 100 which is used by the user.

When receiving a signal indicating that the single-color print mode is set from the operation panel 100, the control device 263 activates each adjusting solenoid 262 of the electric field enlarging equipments 260 set at the transfer positions of the photosensitive drums 221C to 221Y and sets these electric field enlarging equipments 260 to the state shown in FIG. 15B.

Next, the operation performed by the image forming section of the tandem-type copier with the stated construction is explained. The operation for forming a full-color image in the full-color print mode is the same as in the fourth embodiment, and so will not explained. It should be noted here that a high-quality sheet is used as the recording sheet S for forming a full-color image and that all of the electric field enlarging equipments 260 are in the state shown in FIG. 15A, i.e., the normal transfer electric field is maintained at all of the transfer positions in the full-color print mode. The following is a description of the operation for forming a black-and-white image in the single-color print mode.

When the user inputs the single-color print mode using the operation panel 100, the control device 263 activates each adjusting solenoid 262 of the electric field enlarging equipments 260 set at the transfer positions of the photosensitive drums 221C to 221Y.

As a result, the electric field enlarging equipments 260 at the transfer positions of the photosensitive drums 221C to 221Y are set to the state shown in FIG. 15B, that is, each of the electric fields is enlarged. Meanwhile, the electric field enlarging equipment 260 at the transfer position of the photosensitive drum 221K is maintained in the state shown in FIG. 15A, that is, the electric field is maintained normal. It should be noted here that a recycled sheet whose surface is rough is used as the recording sheet S.

The recording sheet S is guided by the sheet guide 230 and electrostatically attracted to the transport belt 211. The recording sheet S is then transported by the transport belt 211 and passes by the image forming units 220C to 220Y which are not used for forming the black-and-white image. Here, the electric field relative to the transport belt 211 at each transfer position of the image forming units 220C to 220Y is enlarged by the corresponding electric field enlarging equipment 260, so that the recording sheet S is attracted and strongly fixed to the transport belt 211 by the increased electrostatic attraction. Accordingly, when the recycled sheet is used as the recording sheet S, the recording sheet S is securely attracted to the transport belt 211 and reliably transported without causing a problem, such as a skew.

The recording sheet S is then transported to the transfer position of the image forming unit 220K, where the black-and white image is transferred onto the recording sheet S. As is the case in the first embodiment, since the recording sheet S is securely attracted and fixed to the transport belt 221, the recording sheet S does not move away from the correct position on the transport belt 221. In addition, the size of the electric field at the transfer position of the image forming unit 220K is maintained normal, causing no toner fly-off onto the recording sheet S before the image is transferred. As a result, a favorable transferred image can be obtained.

Finally, the recording sheet S is separated from the transport belt 211 by the separating charger 215 and the toner particles forming the image on the recording sheet S are fused and fixed in place by the fixing roller 240.

Figure 16:
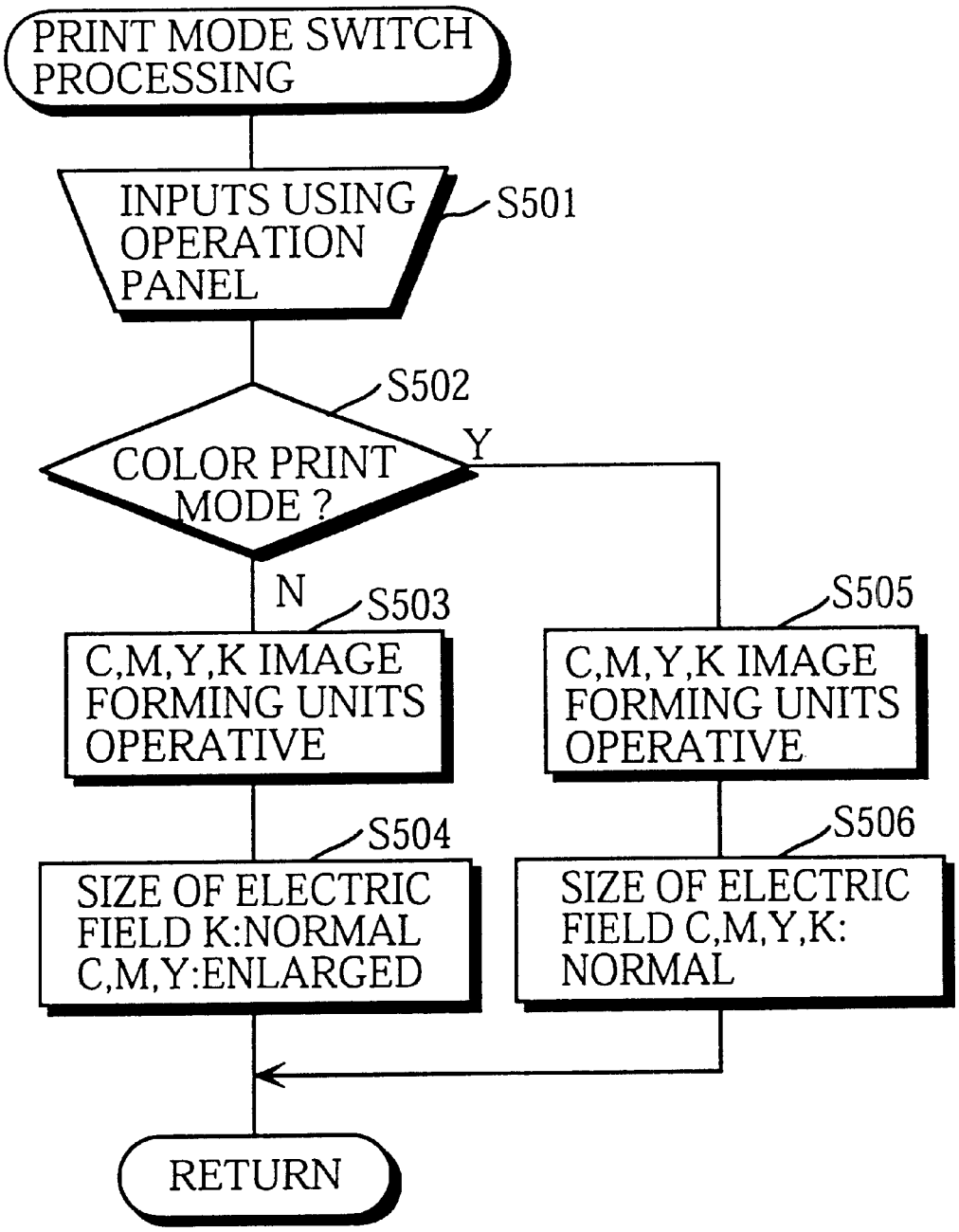
FIG. 16 is a flowchart showing the control operation of the print mode switch processing performed by the control unit of the fifth embodiment.

FIG. 16 is the flowchart showing the above control operation for the print mode switch processing.

When the user sets the print mode using the operation panel 100 (step S501), the control unit 263 judges from the present settings whether the full-color print mode is set (step S502). If not, that is, if the single-color print mode is set, the control unit 263 makes the image forming units 220C to 220K operative (step S503). The control unit 263 then activates the electric field enlarging equipments 260 of the image forming units 220C to 220Y which are not used for forming the image in the single-color print mode to enlarge the respective transfer electric fields relative to the transport belt 211 as well as keeping the transfer electric field of the image forming unit 220K normal (step S504). After this, the control unit 263 returns to the main routine (not shown) of the control operation of the entire copier and executes the black-and-white image formation using only the image forming unit 220K.

Meanwhile, if judging that the full-color print mode is set in step S502, the control unit 263 makes all of the image forming units 220C to 220K operative (step S505). Then, the control unit 263 sets the normal transfer electric fields for the image forming units 220C to 220K without activating the electric field enlarging equipments 260 (step S506). After this, the control unit 263 returns to the main routine (not shown) and executes the full-color image formation using all of the image forming units 220C to 220K.

Although the transfer pressure is not described in the present embodiment, the electrostatic charge adjusting component 261 may be pushed against the transport belt 211. By making the the pressure of the electrostatic charge adjusting component 261 adjustable, the transport belt 211 may be pushed with the pressure appropriate for forming the image when the size of electric field is normal, and may be pushed with the stronger pressure when the size of electric field is enlarged. Consequently, the recording sheet S can be more securely attracted to the transport belt 211 at the transfer positions of the image forming units 220C to 220Y which are not used for forming the image in the single-color print mode, by a synergistic effect between the enlarged electric field and the increased transfer pressure.

As in the cases of the first to third embodiments, the transport surface of the transport belt 211 may be moved away from the photosensitive drums of the image forming units aside from the image forming unit used for forming a black image in the single-color print mode in the fifth embodiment.

In addition, the transfer pressure increasing equipment 250 and the electric field enlarging equipment 260 are described in the fourth and fifth embodiments for the case when the black-and-white image is formed in the single-color print mode. However, the color of the image formed in the single-color print mode is not limited to black-and-white, and may be another single color. Alternatively, a two-color or three-color image can be formed in the single-color print mode. In this case, the transfer pressure increasing equipment 250 may increase the transfer pressure, or the electric field enlarging equipment 260 may enlarge the electric field, relative to the transport belt 211 at each corresponding transfer position of the image forming unit which is not used for forming the image.

To solve the problem in this case, such as the image transfer on the recording sheet at the incorrect position, the transfer pressure may be increased, or the electric field may be enlarged, relative to the transport belt 211 at one or more transfer positions of the image forming units which are not used for forming the image and which are located before the image forming unit which is used for forming the image on the transportation path of the recording sheet S.

Although the tandem-type full-color copier is described as the present invention in the first to fifth embodiments, the present invention is not limited to this. For example, a tandem-type full-color image forming apparatus, such as a laser printer and a facsimile, can be used.

Although the present invention has been fully described by way of examples with reference to the accompanying drawings, it is to be noted that various changes and modifications will be apparent to those skilled in the art.

Therefore, unless such changes and modifications depart from the scope of the present invention, they should be constructed as being included therein.

What is claimed is:

1. An image forming apparatus comprising:

a plurality of image forming units, each including an image holding component on which an image for a different color is formed and including a transfer component for transferring the image formed on each image holding component onto a recording sheet at a respective transfer position;

a transporter for holding a recording sheet and sequentially transporting the recording sheet to each transfer position of the plurality of image forming units;

a controller which coordinates the operation of the plurality of image forming units and the transporter, and which sets a system speed of the image forming apparatus at a first speed when a first mode is set to form a color image using the plurality of image forming units and sets the system speed of the image forming apparatus at a second speed which is faster than the first speed when a second mode is set to form a single-color image using only an image forming unit provided at a most downstream position in a transportation direction of the transporter, with the system speed being equivalent to an image formation speed of each of the image forming units and a transportation speed of the recording sheet by the transporter; and an attraction unit which applies attractive force that attaches the recording sheet to a surface of the transporter, and wherein when the second mode is set, the controller applies to the attraction unit a bias voltage higher than a bias voltage applied when the first mode is set.

2. The image forming apparatus of claim 1, wherein the controller has a recording sheet supporting surface of the transporter moved away from the image forming units which are not used for forming the single-color image when the second mode is set.

3. The image forming apparatus of claim 1, wherein the image forming unit used for forming the single-color image in the second mode forms a black image.

4. An image forming apparatus comprising:

a plurality of image forming units, each including an image holding component on which an image for a different color is formed and including a transfer component for transferring the image formed on each image holding component onto a recording sheet at a respective transfer position;

a transporter for holding a recording sheet and sequentially transporting the recording sheet to each transfer position of the plurality of image forming units; and a controller which coordinates the operation of the plurality of image forming units and the transporter, and which sets a system speed of the image forming apparatus at a first speed when a first mode is set to form a color image using the plurality of image forming units, and sets the system speed of the image forming apparatus at a second speed which is slower than the first speed when a second mode is set to form a single-color image using only one of the plurality of image forming units and a special sheet different from plain paper is used as the recording sheet, with the system speed being equivalent to an image formation speed of each of the image forming units and a transportation speed of the recording sheet by the transporter.

5. The image forming apparatus of claim 4, wherein the controller has a recording sheet supporting surface of the transporter moved away from the image forming units which are not used for forming the single-color image when the second mode is set and plain paper is used as the recording sheet.

6. The image forming apparatus of claim 4, wherein the image forming unit used for forming the single-color image in the second mode forms a black image.

7. The image forming apparatus of claim 4, wherein the special sheet is a sheet used for an overhead projector.

8. The image forming apparatus of claim 4, wherein when the first mode is set, the controller applies to the transfer component a bias voltage higher than a bias voltage applied when the second mode is set.

9. The image forming apparatus of claim 4, further comprising an attraction unit which applies attractive force that attaches the recording sheet to a surface of the transporter, and wherein when the first mode is set, the controller applies to the attraction unit a bias voltage higher than a bias voltage applied when the second mode is set.

* * * * *